US008042977B1

(12) United States Patent
Nourishad et al.

(10) Patent No.: US 8,042,977 B1
(45) Date of Patent: Oct. 25, 2011

(54) TROFFER LUMINAIRE

(75) Inventors: Feriduon Nourishad, Irvine, CA (US); Jose Adame, Fontana, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 514 days.

(21) Appl. No.: 12/115,415

(22) Filed: May 5, 2008

(51) Int. Cl.
*F21V 13/02* (2006.01)

(52) U.S. Cl. ..... 362/343; 362/217.05; 362/308; 362/328

(58) Field of Classification Search ..... 362/222–224, 362/217.01–217.17, 279, 260, 343, 308, 362/309, 327, 328
See application file for complete search history.

(56) References Cited

U.S. PATENT DOCUMENTS

| | | | | |
|---|---|---|---|---|
| 2,899,541 | A * | 8/1959 | De Mauro | 362/222 |
| 3,211,905 | A * | 10/1965 | Picha et al. | 362/222 |
| 3,790,774 | A * | 2/1974 | Miller et al. | 362/220 |
| 3,934,135 | A * | 1/1976 | Szer | 362/330 |
| 4,768,140 | A * | 8/1988 | Szpur | 362/342 |
| 4,891,737 | A * | 1/1990 | Szymanek | 362/223 |
| 6,655,819 | B2 * | 12/2003 | Loga et al. | 362/263 |
| 6,746,133 | B2 * | 6/2004 | Loga et al. | 362/147 |
| 7,510,305 | B2 * | 3/2009 | Straton et al. | 362/294 |
| 2002/0191397 | A1 * | 12/2002 | Loga et al. | 362/247 |
| 2010/0079986 | A1 * | 4/2010 | Ladstaetter | 362/223 |

* cited by examiner

*Primary Examiner* — Bao Q Truong

(57) ABSTRACT

A troffer luminaire having a continuous appearance when connected in aligned fashion within a suspended ceiling. The luminaire has first and second faux reflector assemblies which pivot from within the housing of the troffer luminaire. The troffer luminaire further comprises a removably connected lamp shield which may come in various designs and which therefore makes the lamp shields interchangeable.

15 Claims, 22 Drawing Sheets

TROFFER LUMINAIRE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to a troffer luminaire. More particularly, the invention relates to a troffer luminaire having a structure which provides a continuous run appearance, opposed pivoting faux reflector assemblies, and a removable lamp shield.

2. Description of the Related Art

Suspended ceilings, also known as drop or dropped ceilings, are commonly used to provide a finished ceiling surface in a room or architectural space. Suspended ceilings may be used to conceal a previously existing ceiling or may be used for their ease of installation. Additionally, the suspended ceiling allows access to wireways and ductwork in a convenient manner for maintenance and the like.

The suspended ceiling is typically defined by perpendicular structural members which define squares or rectangles wherein troffer luminaires are positioned. Unfortunately, due to the layout of the structural members, the luminaires are separated and therefore making a substantially continuous uninterrupted lighting run of troffer luminaires has not been accomplished with any success.

Architectural lighting designers also prefer to have a shallow troffer design when utilizing troffer luminaires. One problem with providing a shallow design is that lighting near sides of the troffer spaced from the axis of the lamp are typically unevenly illuminated. Alternatively stated, a shallow profile typically leads to an uneven illumination across the span of the reflector. While the continuous run with troffer luminaire and the shallow profile design are highly desirable, they have not been available in prior art designs. Further, an additional problem with troffer luminaires of the prior art is that the designs have been somewhat difficult to maintain while also providing access to ballast.

It would be desirable to overcome these various problems to provide a low profile to shallow continuous architectural troffer luminaire which is easily accessible for maintenance and re-lamping, as well as providing even illumination across the span of a reflector.

SUMMARY OF THE INVENTION

A troffer luminaire comprises a luminaire housing having a first longitudinal end and a second longitudinal end, a rear reflector disposed within the luminaire housing, a first casting pivotally mounted within the luminaire housing at the first end and a second casting pivotally mounted opposite the first casting, a first faux reflector mounted to the first casting beneath the rear reflector, and, a second faux reflector mounted to the second casting beneath the rear reflector. The troffer luminaire of the troffer housing having a first side and a second side extending between the first end and the second end. The troffer luminaire wherein the first end has the first casting and the second casting. The troffer luminaire wherein the second end an opposed first casting and an opposed second casting. The troffer luminaire wherein each of the castings having a casting arm and a first lens wall and a second lens wall. The troffer luminaire further comprising the faux reflector disposed between the first and second lens walls. The troffer luminaire further comprising an extrusion disposed at the first and the second end of said fixture housing. The troffer luminaire further comprising a second extrusion opposite the extrusion. The troffer luminaire wherein the first casting and the second casting are pivotally connected to the first extrusion and the second extrusion, respectively. The troffer luminaire wherein the first faux reflector extends from the first casting at the first end to the first opposed casting at the second end.

A shallow luminaire assembly comprises a releasable diffuser, a first pair of castings and a second pair of castings pivotally positioned in a fixture housing, a faux reflector pivotable with the first pair of castings and the second pair of castings, and, each of the first and second pairs of castings receiving the faux reflector. The shallow luminaire assembly wherein the faux reflector has a first lens hook and a second lens hook. The shallow luminaire assembly wherein the diffuser releasably connects to the castings. The shallow luminaire assembly further comprising a rear reflector within the fixture housing. The shallow luminaire assembly wherein the faux reflector has a curved portion. The shallow luminaire assembly wherein said faux reflector is captured by the castings. The shallow luminaire assembly further comprising an extrusion wherein one of said first pair of castings and one of said second pair of castings is pivotally connected to said extrusion.

A luminaire assembly comprises a troffer housing, a rear reflector disposed within the troffer housing, a first faux reflector assembly pivotally mounted within the housing and beneath the rear reflector, a second faux reflector assembly pivotally mounted within the housing and beneath the rear reflector, and, a faux reflector disposed in each of the first and second faux reflector assemblies, the reflectors being backlit by a lamp and the rear reflector. The luminaire assembly further comprising a first casting and a second casting at each end of the troffer housing. The luminaire assembly further comprising a first opposed casting and a second opposed casting at an opposite end of the troffer housing. The luminaire assembly further comprising a first faux reflector extending between the first casting and the first opposed casting.

The luminaire assembly further comprising a second faux reflector extending between the second casting and the second opposed casting. The luminaire assembly further comprising a lower casting structure defining an opening and a lamp shield disposed over the opening.

A luminaire assembly, comprises a troffer fixture housing, a rear reflector positioned within the fixture housing, a first casting pivotably positioned within the fixture housing beneath the rear reflector, a second casting pivotably positioned within the fixture housing beneath the rear reflector, a curved faux reflector providing a shallow appearance for the luminaire assembly, a second troffer fixture housing connected to the first fixture housing; and, the second fixture housing having a second curved faux reflector, wherein the first curved faux reflector and the second curved faux reflector have a substantially continuous appearance in a longitudinal direction. The luminaire assembly wherein the curved faux reflector has a substantially straight portion depending downwardly at an angle. The luminaire assembly further comprising a lamp shield disposed beneath each of the first curved reflector and the second curved reflector. The luminaire wherein the lamp shields have a substantially continuous appearance. The luminaire assembly further comprising a bulkhead disposed between the first troffer fixture and the second troffer fixture. The luminaire assembly wherein the bulkhead has a lower curved edge which substantially matches the curvature of the first curved faux reflector and the second faux curved reflector.

A troffer luminaire assembly comprises a plurality of longitudinally extending ceiling members, a plurality of latitudinal extending ceiling members, an opening defined by the ceiling members extending longitudinally and uninterrupted by the latitudinal ceiling member, at least a first troffer housing disposed within the opening, at least a second troffer housing disposed within the opening adjacent the at least first troffer housing, the at least first and second troffers each having a bulkhead, the bulkheads joined together, and, a clip connected to each bulkhead and engaging at least one of said longitudinal or latitudinal member. The troffer luminaire assembly further comprising at least one wire connected to the bulkheads and supporting the troffer luminaire assembly. The troffer luminaire assembly wherein the clip has first and second legs, the first and second legs straddling the latitudinally extending ceiling members. The troffer luminaire assembly further comprising at least one foot extending from the first and second legs, the at least one foot engaging at least one of said plurality of longitudinally extending ceiling members.

A luminaire assembly, comprises a first troffer housing, a first faux reflector disposed within the first troffer housing, a second troffer housing, a second faux reflector disposed within the second troffer housing, a plurality of ceiling structural members extending along sides of the first troffer housing and the second troffer housing, wherein a space between the first troffer housing and the second troffer housing is free of the ceiling structural members and wherein the first and second faux reflectors appear substantially continuous.

A troffer luminaire, comprises a troffer housing, a rear reflector, a first faux reflector assembly pivotally mounted in the troffer housing, a second faux reflector assembly pivotally mounted in he troffer housing opposite the first reflector assembly, and, an interchangeable diffuser connected to the first faux reflector assembly and the second faux reflector assembly. The troffer luminaire wherein the diffuser has a plurality of perforations. The troffer luminaire wherein the diffuser having at least one lens. The troffer luminaire wherein the interchangeable diffuser is toollessly removable. The troffer luminaire wherein the diffuser receives light from the lamp through and opening between said first reflector assembly and said second reflector assembly. The troffer luminaire wherein the interchangeable diffuser is mounted beneath an opening defined between the first faux reflector assembly and the second faux reflector assembly.

A troffer luminaire, comprising a troffer housing, a rear reflector disposed within the troffer housing, at least one faux reflector assembly pivotally mounted within the troffer housing, a removable diffuser mounted on the at least one faux reflector assembly; and, the removable diffuser being mountable and dismountable in a tool-less manner. The troffer luminaire further comprising a plurality of spring clips mounted to one of the at least one faux reflector assembly and the removable diffuser. The troffer luminaire further comprising a plurality of pins extending from the other of said removable diffuser and said at least one faux reflector. The troffer luminaire wherein the plurality of spring clips are releasably engaging thr plurality of pins.

A luminaire comprises a fixture housing, a rear reflector, a first pivotable reflector extending between a first casting and a second casting, a second pivotable reflector extending between a third casting and a fourth casting, the first pivotable reflector having a lower portion and the second pivotable reflector having an adjacent lower portion, the lower portions having a preselected geometric shape and defining a lower aperture, a diffusing lamp shield removably connected to the castings and covering the lower aperture. The luminaire wherein the castings having one of pins or spring clips. The luminaire wherein the lamp shield has the other of pins or springs clips. The luminaire wherein the pins engage the spring clips. The luminaire wherein the lamp shield is interchangeable with alternate shields.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
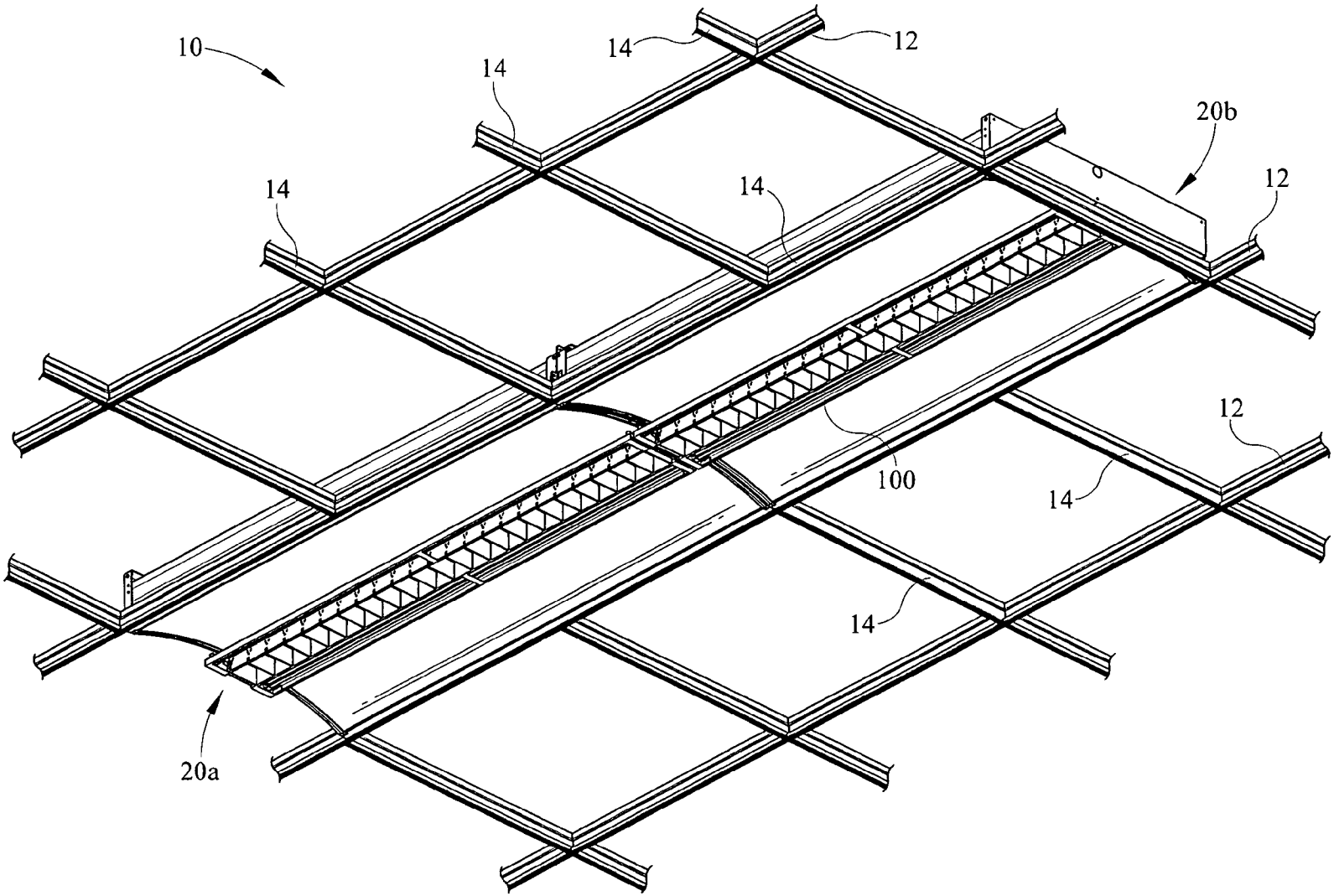
FIG. 1 depicts lower perspective view of a suspended ceiling structure including a continuous architectural trough formed by multiple troffer fixtures.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Additionally, it should be understood that various components taught herein may be utilized with bollards and other luminaires, so the claims provided herein should not be considered as limited to bollard luminaires unless such is explicitly claimed.

Figure 12B:
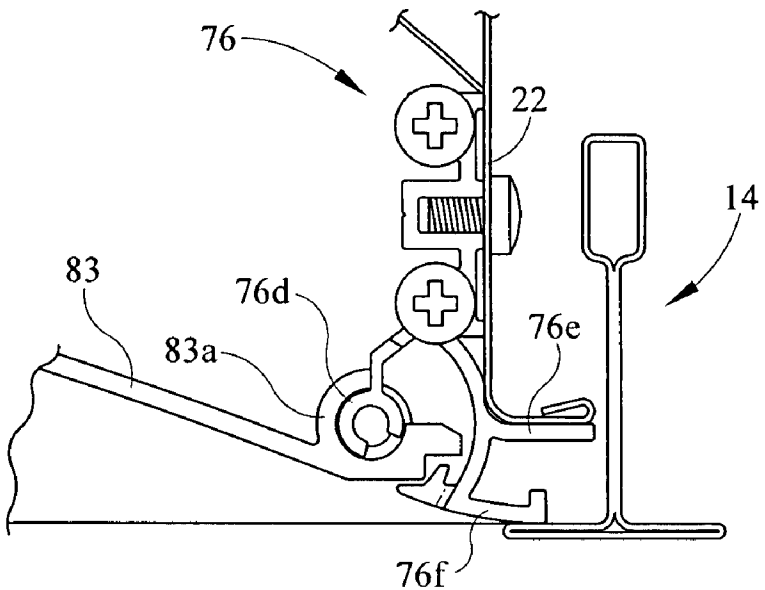
FIGS. 12A and 12B depict a front view of the engagement of the extrusion of FIG. 11 with two types of T-grid structure.

Referring initially to FIG. 1, a lower perspective view of a suspended ceiling structure 10 is depicted. The suspended ceiling 10 is formed of a plurality of longitudinal suspended ceiling members 12, and latitudinal extending members 14. The terms longitudinal and latitudinal are defined with respect to lamp fixtures 20 described herein. The longitudinal direction corresponds to the direction of the luminaire lamp, while the latitudinal direction corresponds to a perpendicular direction from the lamp. The exemplary embodiment depicts a first fixture 20*a* and a second fixture 20*b*, which are generally known as troffer type fixtures, and are suspended from ceiling structure with aircraft cable, wire or other such suspension type system. The troffers 20*a*, 20*b* are seated within or adjacent to the longitudinal ceiling members 12. The longitudinal run of troffer luminaires may be formed of two types of troffers. A starter troffer may be used at ends of a run of troffer luminaires and utilizes end caps. Alternatively, between starter troffers, joiner troffers may be utilized. Since only two troffers are shown, the troffers depicted are starter troffers. The longitudinal and latitudinal ceiling members 12, 14 may be slotted T-grid (FIG. 12A) or inverted T-grid (FIG. 12B) or other such known grid members.

The exemplary troffers 20*a*, 20*b* are connected in such a way as to provide a substantially continuous run of fixture lighting which are not separated by spaces in the ceiling structure 10, and which are not interrupted by the latitudinal ceiling members 14 extending between the troffers 20*a*, 20*b*. The term substantially continuous is meant to require that adjacent troffers and reflectors mounted within said troffers are not separated by latitudinal ceiling members and therefore the at least faux reflectors or lenses positioned within the troffer have a substantially continuous appearance. Thus, the assembly of multiple troffers has a more aesthetically pleasing look than with prior art designs which are interrupted by latitudinal ceiling members. Additionally, the troffers 20*a*, 20*b* have a low-profile or shallow appearance because of the backlit faux reflectors described further herein extending less than about halfway upwardly within the troffer 22.

Figure 2:
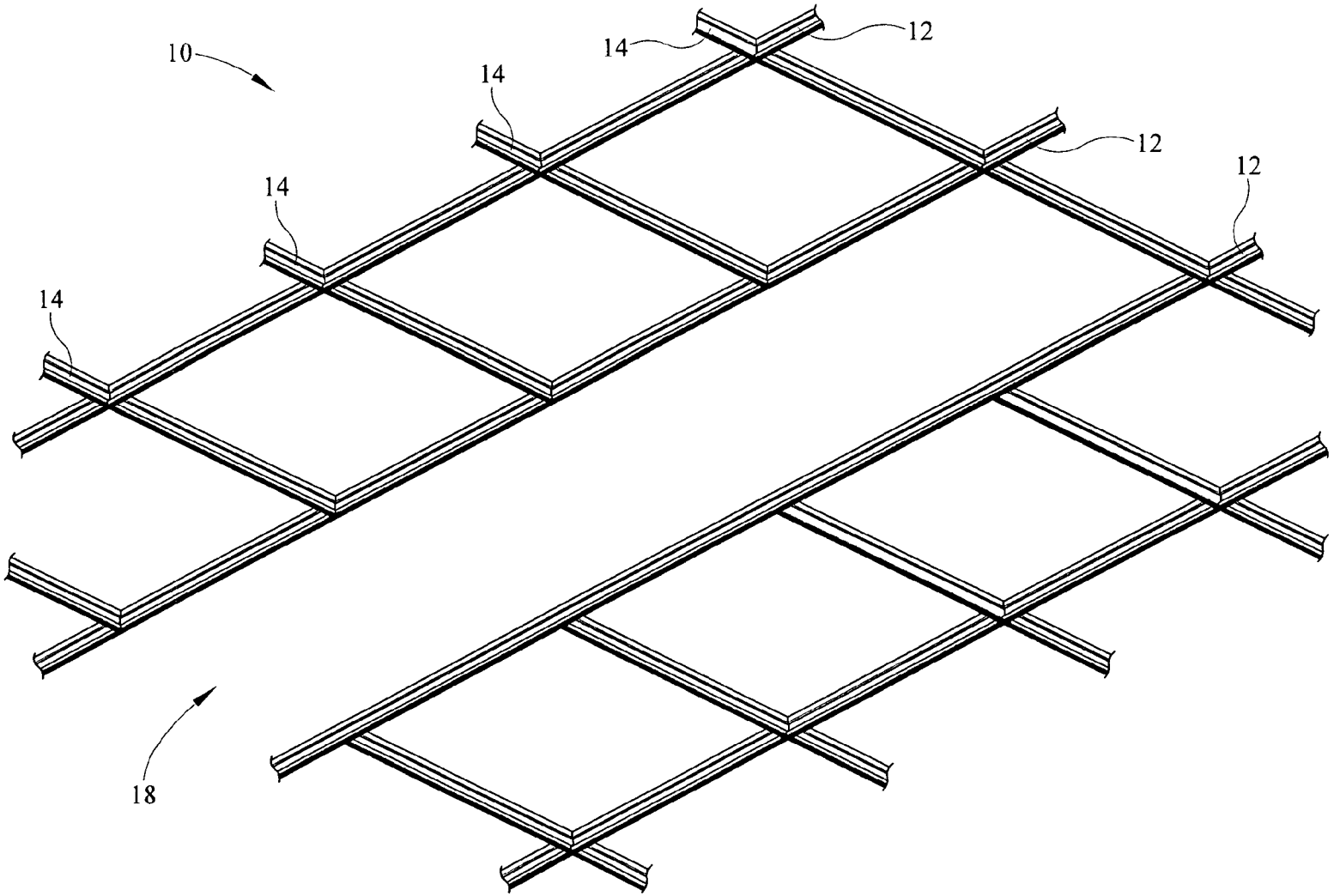
FIG. 2 depicts a lower perspective view of the suspended ceiling structure with the troffer fixtures removed and depicting the continuous row opening within the suspended ceiling structure.

Referring now to FIG. 2, a lower perspective view of the ceiling structure 10 is depicted with the troffers 20 removed. The ceiling structure 10 is formed by the longitudinal and latitudinal ceiling members 12, 14 which form a grid opening 18 wherein the troffers 20 are positioned. The grid opening 18 extends longitudinally and is not interrupted by latitudinal ceiling members 14. Without the latitudinal member 14 extending across the opening 18, the troffers 20 have a continuous appearance when the plurality of luminaires are installed. Moreover, once installed, the troffers 20 aid to support the ceiling members 12, 14.

Figure 3:
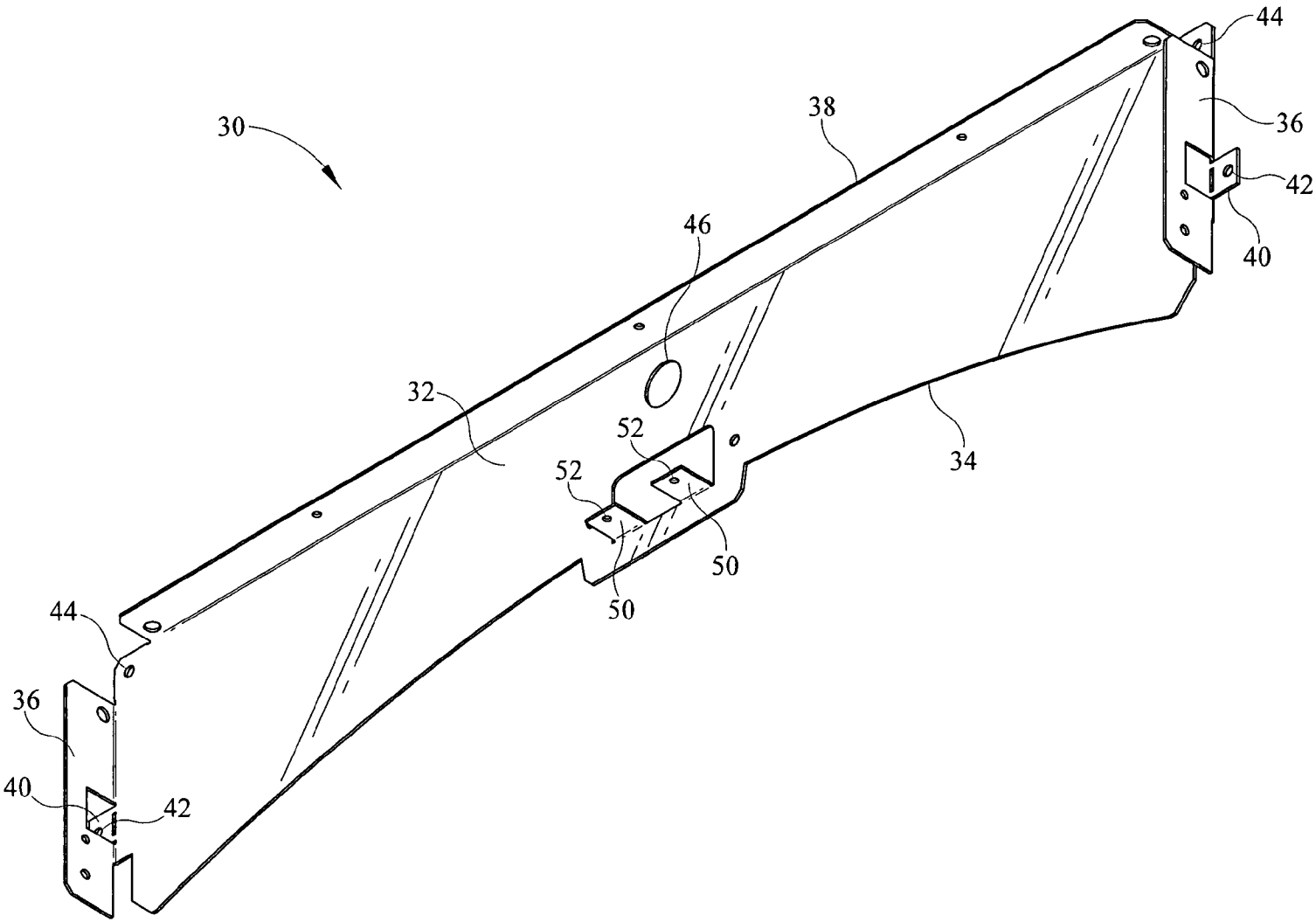
FIG. 3 depicts a perspective view of a bulkhead for connecting adjacent troffer fixtures.

Referring now to FIG. 3, a bulkhead 30 is depicted in perspective view. The bulkhead 30 is positioned at each end of a joiner troffer or at one end of a starter troffer. Adjacent bulkheads 30 are fastened together to connect the adjacent troffers 20. Additionally, the bulkheads 30 aid to maintain integrity of the ceiling structure 10. The bulkhead 30 comprises a wall 32 which is generally four-sided and wherein a lower edge 34 is curvilinear in shape. The curvilinear lower edge 34 matches the shape of the curvature of lenses 83 and castings 30. Accordingly, when viewed from below, the bulkhead 30 is not shown. Along vertical edges of the wall 32 are end tabs 36 and along the upper horizontal edge of the wall 32 is an upper tab 38. The tabs 36, 38 are utilized to connect the bulkhead 30 to longitudinal ends of the troffers 20. Since the bulkheads 30 also have the function of connecting adjacent troffers to one another, each end tab 36 comprises a bulkhead joiner tab 40. Each joiner tab 40 comprises at least one joiner aperture 42. The wall 32 of the exemplary embodiment also comprises joiner apertures 44 at the upper corners thereof although such location should not be considered limiting. Each joiner aperture 42, 44 receives a fastener which passes through or joins adjacent bulkheads 30.

Figure 8:
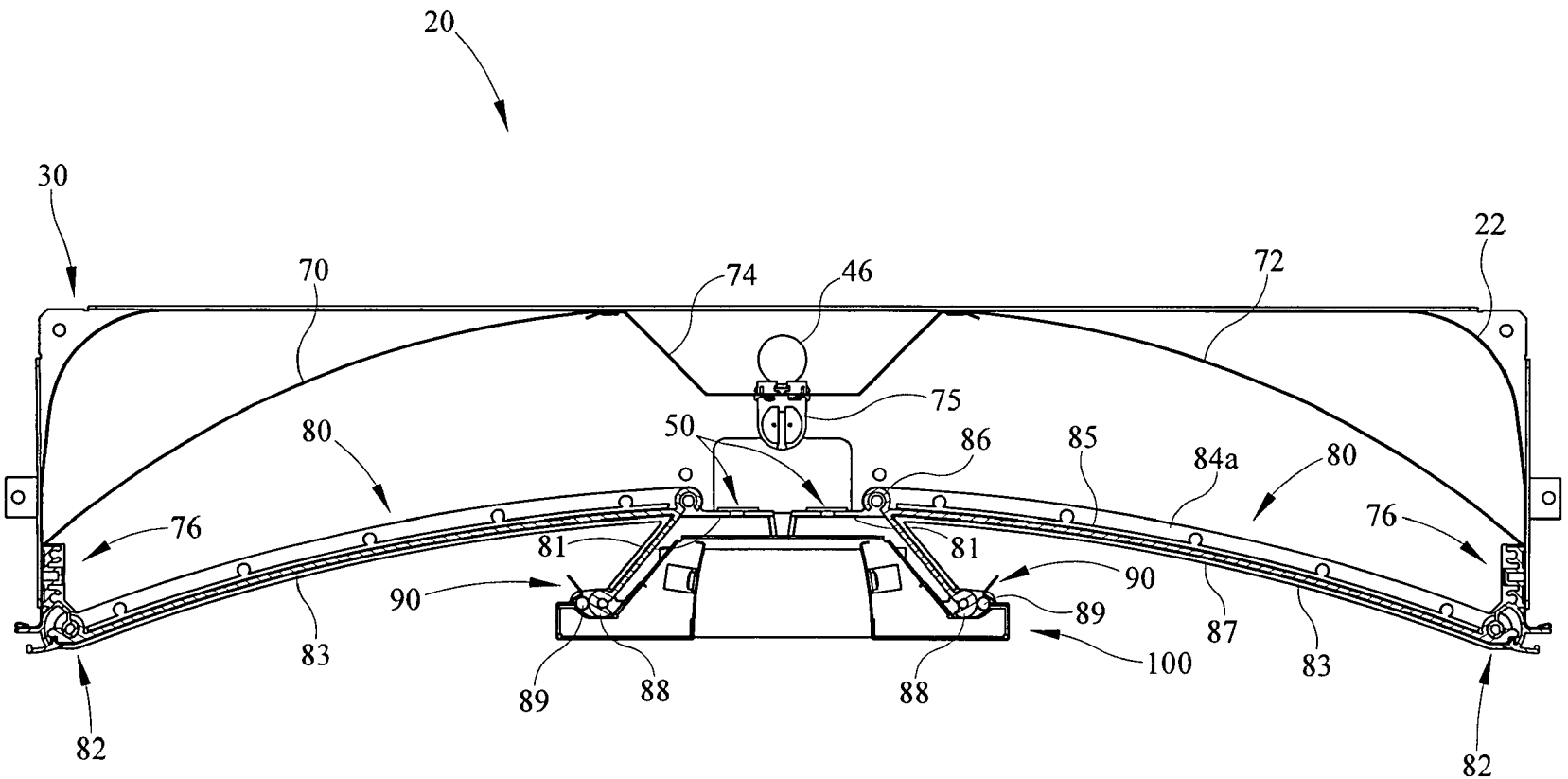
FIG. 8 depicts a section view of a troffer fixture.

The bulkhead wall 32 also comprises a wireway 46. The wireway 46 is circular in shape, but various aperture sizes and shapes may be utilized. The wireway 46 is also centrally positioned, however alternative locations may be utilized. It may be desirable however, to locate the wireways 46 at a position adjacent to or aligned with a luminaire ballast (not shown) with ballast channel 74 (FIG. 8). Beneath the wireways 46 is at least one casting tab 50. According to the exemplary embodiment two casting tabs 50 are utilized with fastening apertures 52. Each casting tab 50 is connected to a casting 80 (FIG. 10) described further herein for operation of the luminaire. Once disconnected from the casting tabs 50, the castings 80 may be pivoted downwardly.

Figure 4:
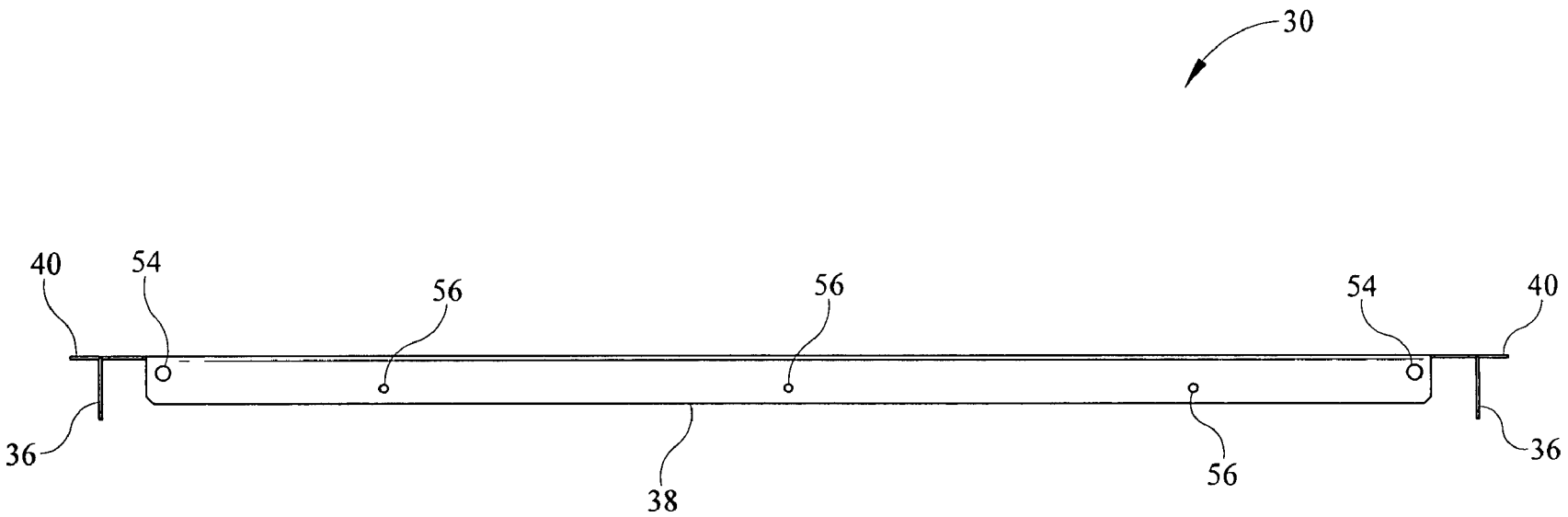
FIG. 4 depicts a top view of the bulkhead of FIG. 3.

Referring now to FIG. 4, a top view of the bulkhead 30 is depicted. The bulkhead upper tab 38 depicts plurality of fastening apertures 56 which connect the bulkhead 30 to the troffer 20. The apertures 56 may be utilized with fasteners, such as rivets or screws to connect the bulkhead 30 to the troffer 20. Additionally, suspension wire apertures 54 are depicted at ends of the upper tab 38 as well. Adjacent the horizontally extending upper tab 38 are the vertically extending end tabs 36. Likewise, the bulkhead joiner tabs 40 are depicted extending from the end tabs 36 and are generally aligned with the bulkhead wall 32. The joiner tabs 40 align with adjacent tabs 40 of an adjacent bulkhead 30 for connection of the bulkheads 30. As a result, the adjacent housings 22 are also connected.

Figure 5:
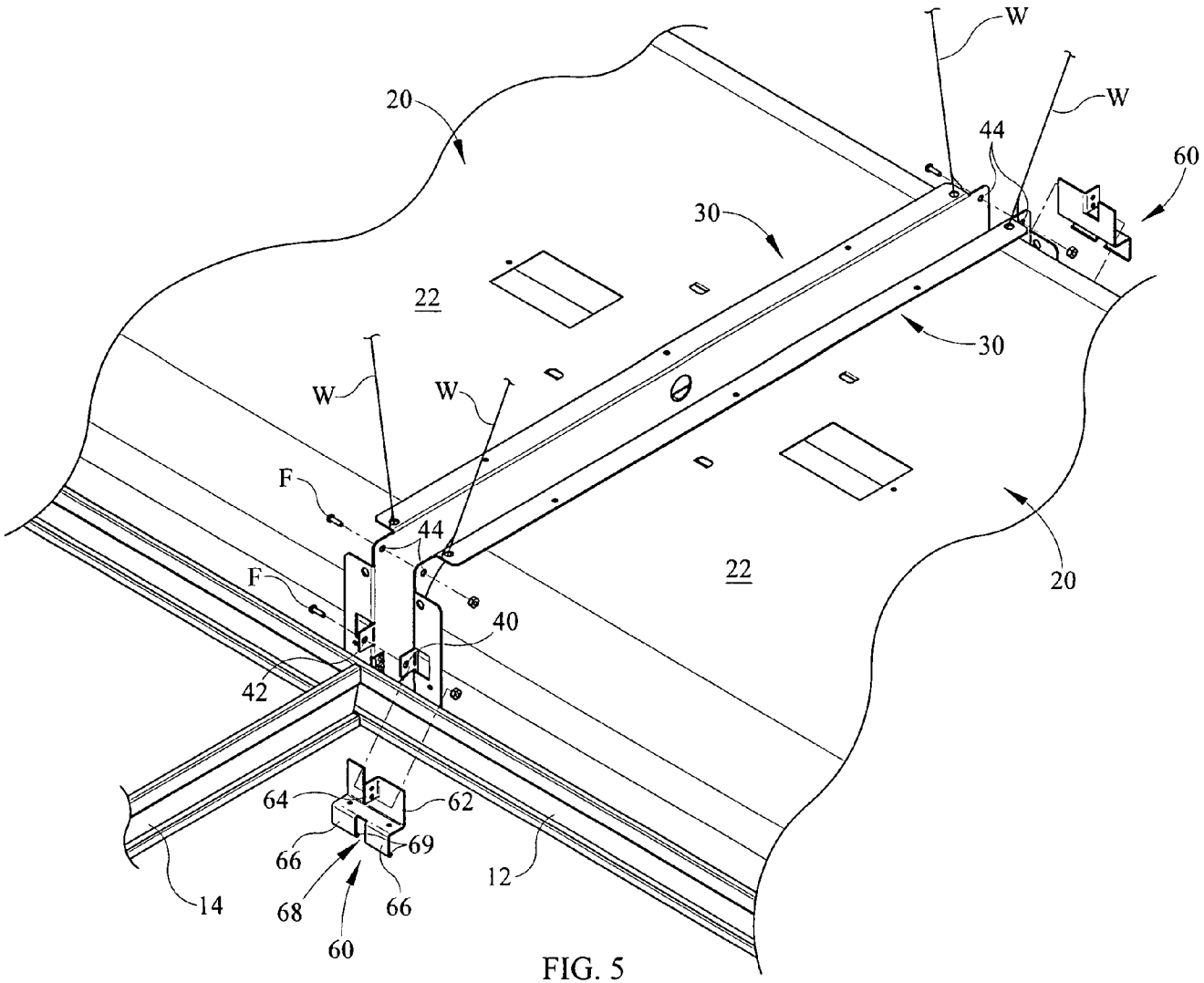
FIG. 5 depicts an upper perspective view of two troffers being moved together for connection by adjacent bulkheads.

Referring now to FIG. 5, an upper perspective view of first and second fixture housings are depicted spaced apart prior to joining. The bulkheads 30 are fastened to housings fixtures 22. Various types of fasteners may be utilized but are not shown. Suspension wires W depend from a building structure and connect to each of the bulkheads 30. At upper corners of the bulkheads 30 a fastener extends through the aligned joiner apertures 44. Beneath the joiner apertures 44 the bulkhead joiner tabs 40 also include a fastener extending between the aligned joiner apertures 42. Adjacent the bulkhead joiner tabs 40 is a clip 60 which is fastened to the tabs 40 by the fastener F. The clips 60 connect the bulkheads 30 and fixtures 20 to the ceiling members 12, 14. In this way, the bulkheads 30 also support the ceiling structure 10. The clip 60 has a body 62 with a tab 64, which is aligned with and engages at least one of the bulkhead joiner tabs 40 for fastening. The tab 64 includes at least one aperture 65 which receives the fastener F passing through the bulkhead joiner tabs 40. Beneath the body 62 are first and second legs 66. The legs 66 define a grid notch 68 there between. The grid notch 68 receives or straddles the latitudinal grid ceiling member 14 therein. At ends of the legs 66 are feet 69 which grasp an edge of the adjacent longitudinal ceiling member 12. Thus, the suspension wires W support the fixtures 20 which are connected to the ceiling grid members 12, 14 by the opposed clips 60. Therefore, the suspension wires W and the fixtures 20 also support and maintain the integrity of the suspended ceiling members 12, 14. The clips 60 are utilized on both sides of the fixtures 20.

Figure 6:
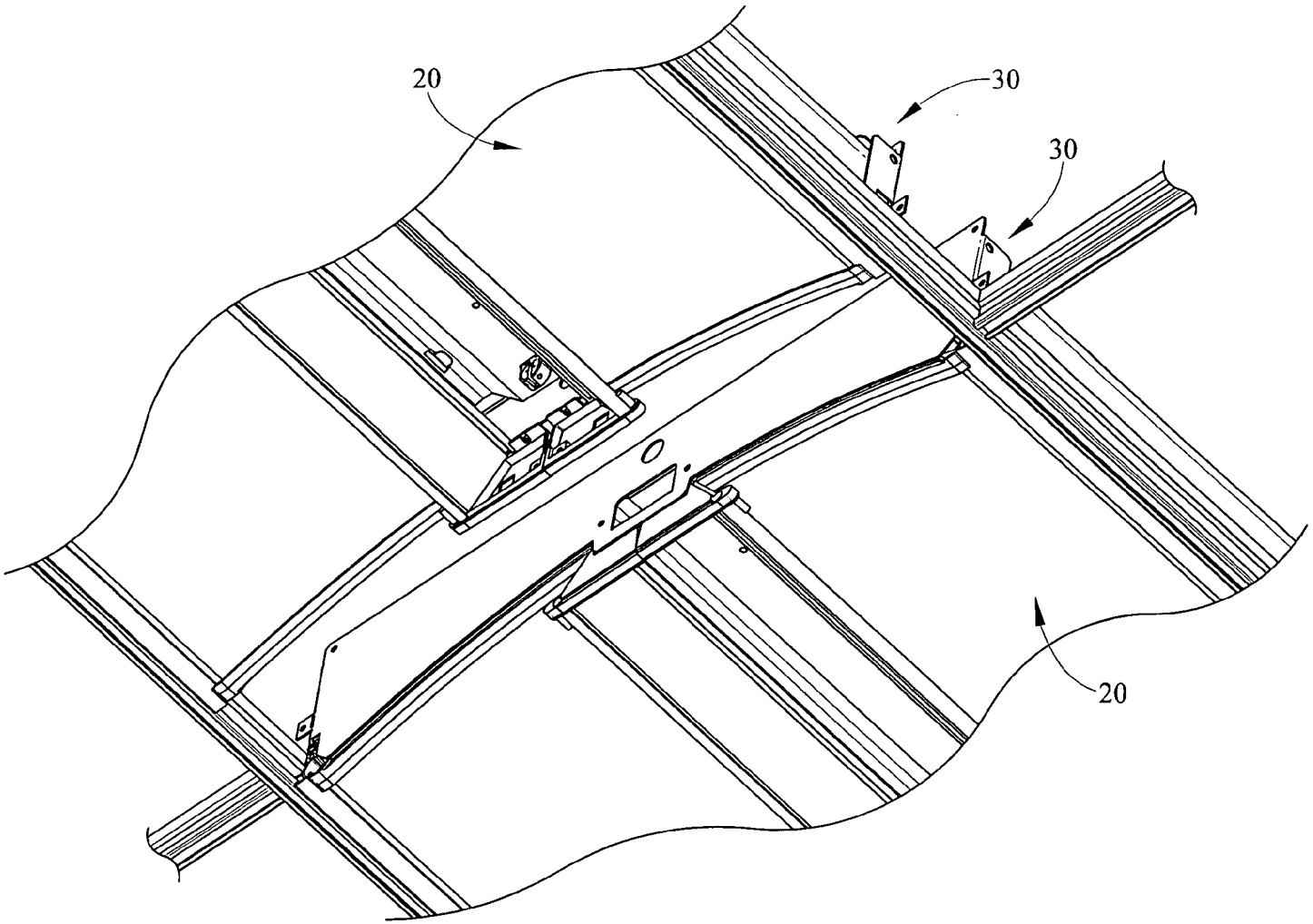
FIG. 6 depicts a lower perspective view of the two troffers of FIG. 5 moving together for connection by adjacent bulkheads.
Figure 7:
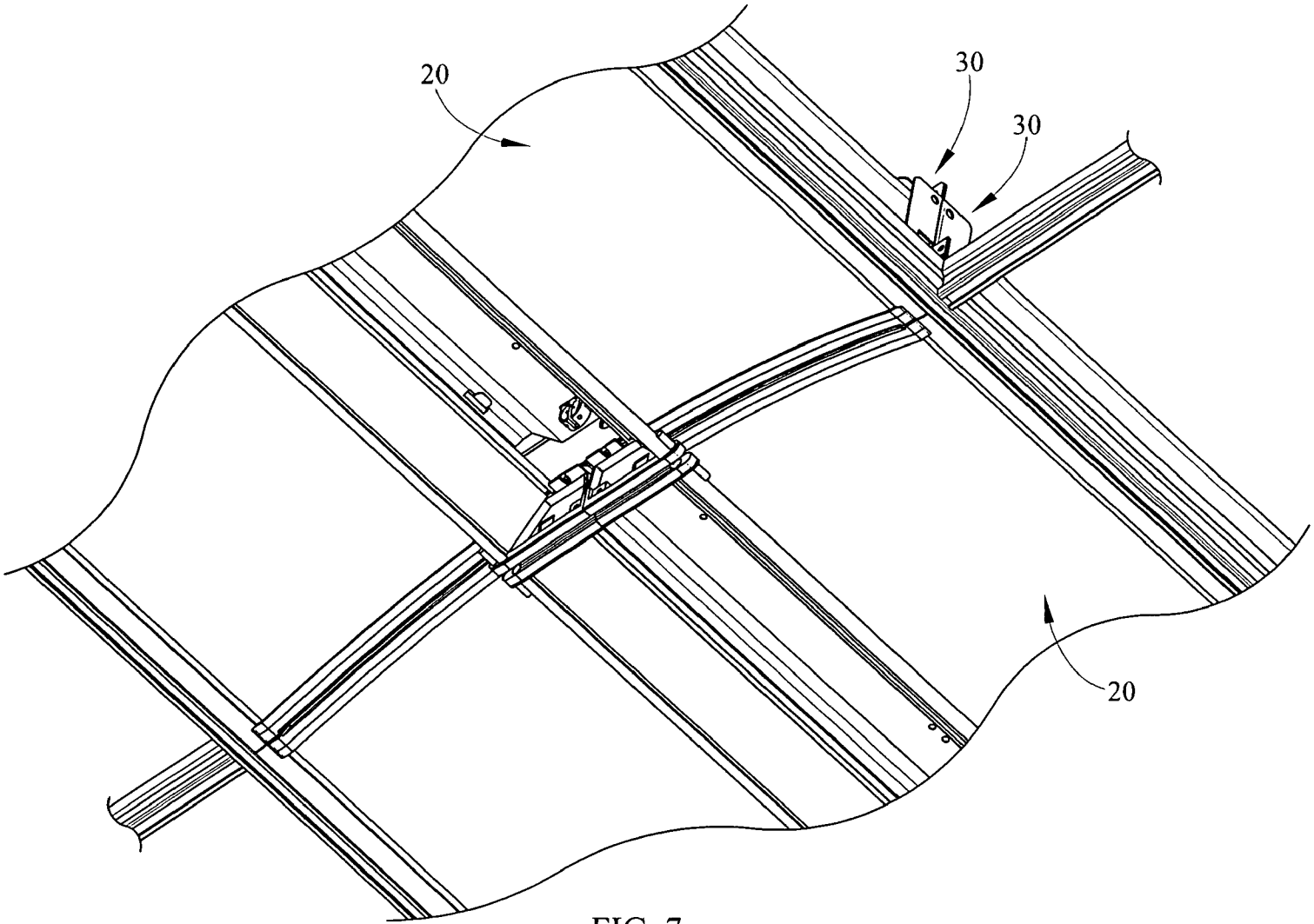
FIG. 7 depicts the two troffers of FIG. 6 positioned together for connection of the bulkheads.

Referring now to FIG. 6, a lower perspective view of the fixtures 20 within the ceiling structure 10 is depicted. The fixtures 20 are spaced apart prior to joining the bulkheads 30 with fasteners. By moving the bulkheads together, as shown in FIG. 7, the bulkheads 30 are fastened together and the fixtures 20 are joined. This process is repeated for any number of fixtures in a run of troffer lighting. Additionally, the clips 60 (FIG. 5) are utilized to connect the various structures as previously described. At ends of the run, starter troffers are used which have end caps at the unconnected ends of the troffers.

Referring now to FIG. 8, a cross-sectional view of the fixture 20 is depicted. The fixture 20 comprises a fixture housing 22 which is generally an upside-down U-shaped structure having curvilinear walls between a substantially upper horizontal wall and substantially vertical end walls. As depicted, each end of the fixture housing 22 has first and second sides on either side of center axis, generally defined by the lamp socket 75. At each end of the fixture 22, there is a first casting 80 and a second opposed 80. Within each fixture, there is a pair of castings 80 on each side of the centerline of the housing. Each pair of castings 80 includes a lens 83, shown in cross-hatch. Further, each pair of castings 80 and lens 83 mounted therein define a faux reflector assembly. The bulkhead 30 is shown connected to the fixture housing 22.

A ballast channel 74 is disposed centrally in the housing 22, and depends from the central upper portion of the housing 22. The ballast channel 74 has an outer surface formed of a reflective material, so as to reflect light into rear reflectors 70,72. Extending between the sidewalls of the fixture housing 22 and the ballast channel 74 are the first and second rear reflectors 70, 72. The rear reflectors 70, 72 are curvilinear in shape, and are formed of reflective sheet aluminum, however other materials may be utilized such as alternate metals, reflective plastics, and optically coated materials. The rear reflectors 70, 72 are substantially convex in curvature and reflect light downwardly from the lamp (not shown) into the faux reflector or lens 83. Despite the convex curvature of the faux reflector 83, the faux reflector 83 extends less than halfway upwardly within the fixture 22 providing a low-profile or shallow appearance from below. Light reflected from the rear reflectors 70,72 into the faux reflector 83 provides a backlit appearance which allows for substantially even or uniform illumination across the faux reflector 83 despite the shallow or low-profile design. Depending from the bottom surface of the ballast channel 74 is a lamp socket 75 which receives a linear fluorescent lamp such as a T-5 or T-8 lamp, as will be understood by one skilled in the art. And, although a single socket 75 is depicted at one end of the luminaire 20, multiple sockets 75 may be utilized with multiple lamps within a single troffer 20.

The lower ends of the faux reflectors 83 engage pivot extrusions 76 located on the end rolls of the fixture housing 22, and described further herein. Extending from the pivot extrusion 76 toward a central location of the fixture 20 are castings 80. The faux reflectors or lens 83 are located within the castings 80. Specifically, a casting 80 at each end of a single side of the housing 20 retains a lens or faux reflector 83 and therefore define the reflector assembly which pivots downwardly. There are two assemblies which are disposed within each troffer housing 20. The assemblies, including faux reflectors 83 span across the lower opening of the housing 22. The castings 80 are connected to casting tabs 50 of the bulkhead 30 to be retained in place. However, by unfastening the castings 80, the castings 80 and lenses 83 may pivot downwardly revealing the interior of the fixture housing 22. Connected to the lower portions of the castings 80 is a diffuser or lamp shield 100. The lamp shield 100 may comprise various forms as described further herein, so that the different types of shields may be utilized with the fixture 20 to provide various looks for a light designer.

The casting 80 is shown comprising a casting arm 84*a*, which is generally vertically oriented. The casting arm 84*a* includes an upper lens wall 85 extending from the arm 84*a* and a lower lens wall 87 extending from the arm 84*a* and which define a gap there between. A lens or faux reflector 83, shown in cross-hatch is positioned within this gap or groove. At an inner end of the casting arm 84 is a substantially trapezoidal structure 84*b*.

Figure 9:
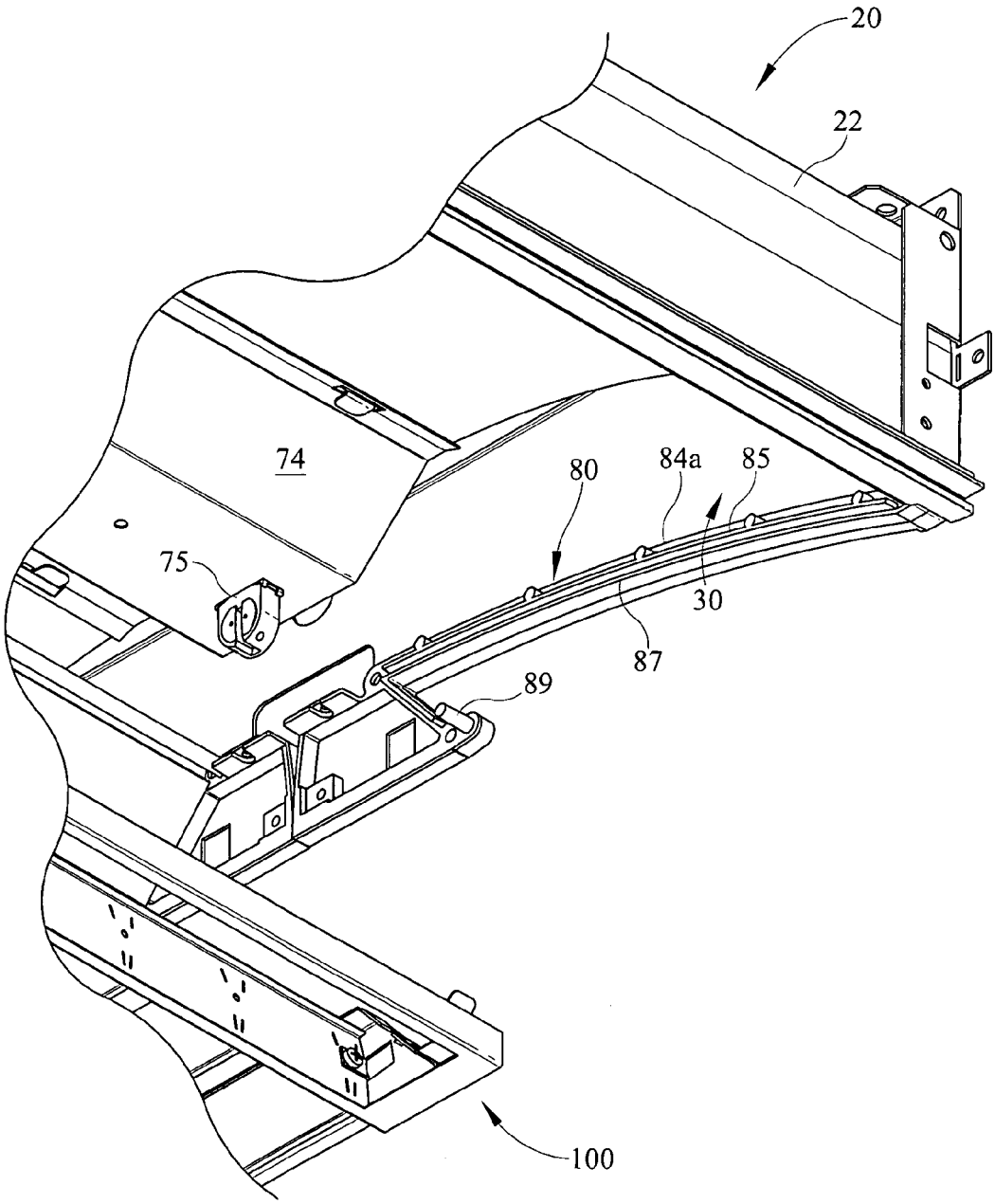
FIG. 9 depicts a partial perspective view of the troffer fixture with the lamp shield exploded from the housing; and, FIG. 10 depicts a front view of a casting removed from the luminaire housing.

Referring now to FIG. 9, lower perspective view of the fixture housing 20 is depicted with the lamp shield or diffuser 100 exploded from the assembly. With the lamp shield 100 exploded from the casting 80 and housing 22, a pin 89 is depicted which is connected by a flexible spring to the diffuser 100 in order to retain the diffuser in place. The lamp shield 100 utilizes four springs and engages four pins 89 located along each of the first and second castings 80 at the first and second longitudinal ends of the fixture 20. Alternatively, however, the pins 89 could be positioned on the diffuser 100 and the springs 90 could be positioned on the castings 80.

Figure 10:
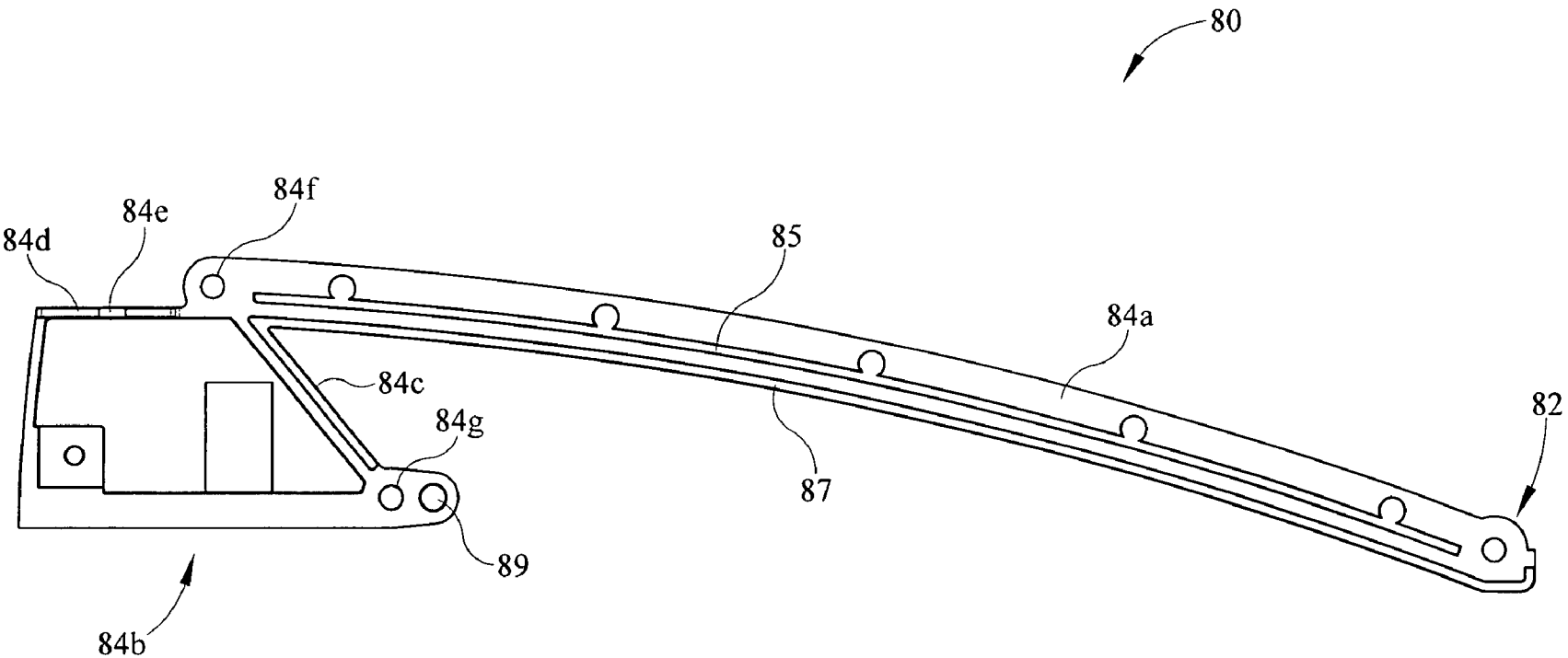

Referring now to FIG. 10, a front view of the casting 80 is depicted. Connected to the casting arm 84*a* is the lamp shield mounting structure 84*b*. The structure 84*b* is substantially trapezoidal in shape, although alternative shapes may be utilized. The mounting structure has a leg 84*c* depending downwardly and diagonally against which a portion of the faux reflector is mounted. The leg 84*c* has an upper end, which is connected to the casting arm 84*a*. Near this intersection, is a lens aperture 84*f*. Near the bottom end of the leg 84*c* is a lower lens aperture 84*g*. At an upper end of the casting arm 84*a* and defining an upper edge of the structure 84*b* is a fastening tab 84*d*. The tab has an upper surface which is seated against the lower surface of casting tabs 50 and has an opening which is aligned with casting tab apertures 52. When the casting 80 is in the upright position, shown in FIG. 9, a fastener is utilized to extend through the casting tab 50 and fastening aperture 84*e*.

Referring briefly again to FIG. 8, the lens 83 includes a pivot 82, an upper lens hook 86 and a lower lens hook 88 which are aligned with apertures 84*f* and 84*g*, respectively. The lens 83 extends from near the outer edge of housing 22 to an inner central portion at the structure 84*b*. The lens 83 also extends in a second direction downwardly between the apertures 84*f* and 84*g*. The lens hooks 86 and 88 are co-axially aligned with the apertures 84*f* and 84*g*. Once aligned, a fastener extends through both the apertures 84*f*, 84*g* and the hooks 86, 88. The lens 83 may be formed of an extruded acrylic or other such suitable material.

Figure 11:
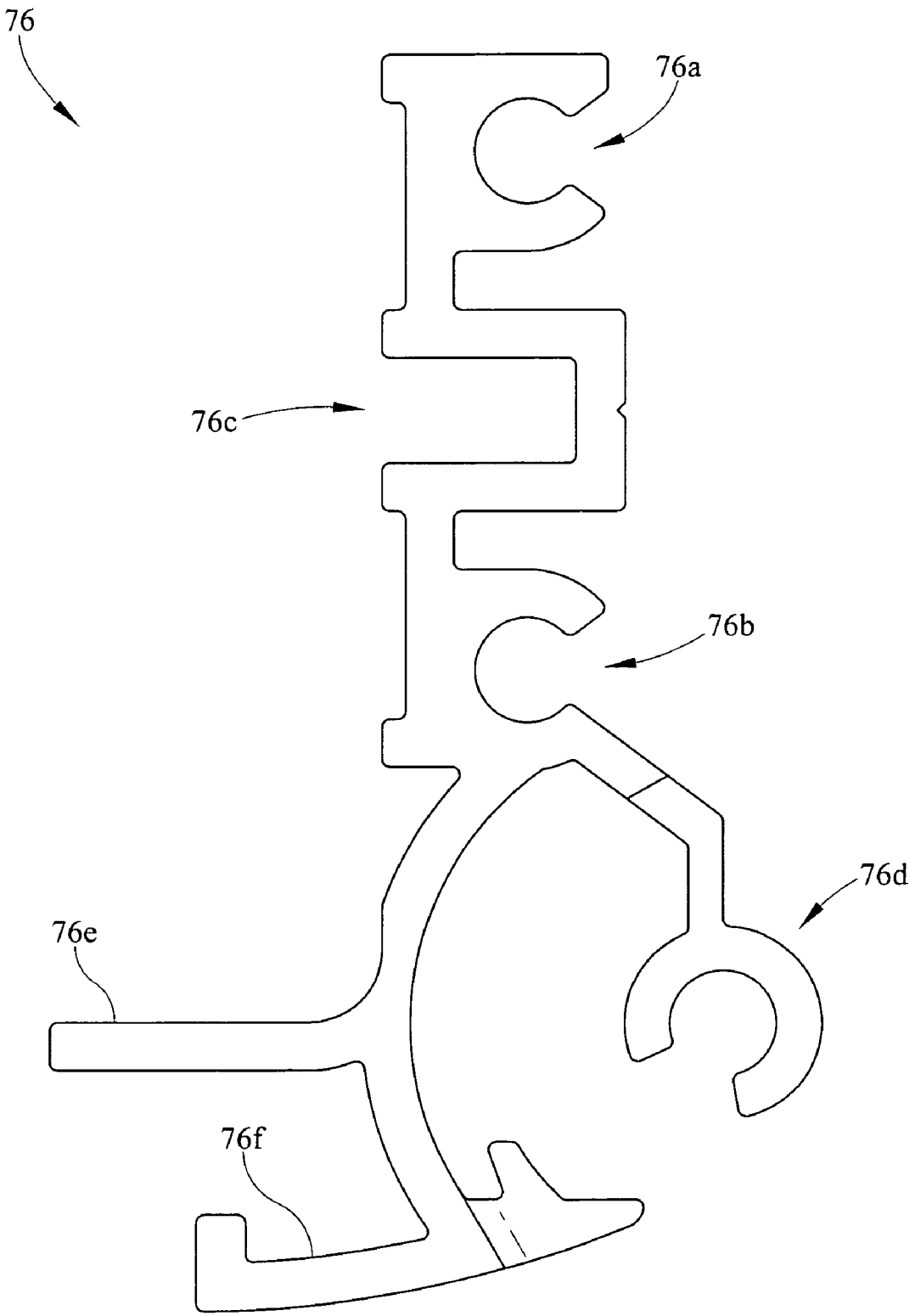
FIG. 11 depicts a front view of an extrusion removed from the luminaire housing.
Figure 12A:
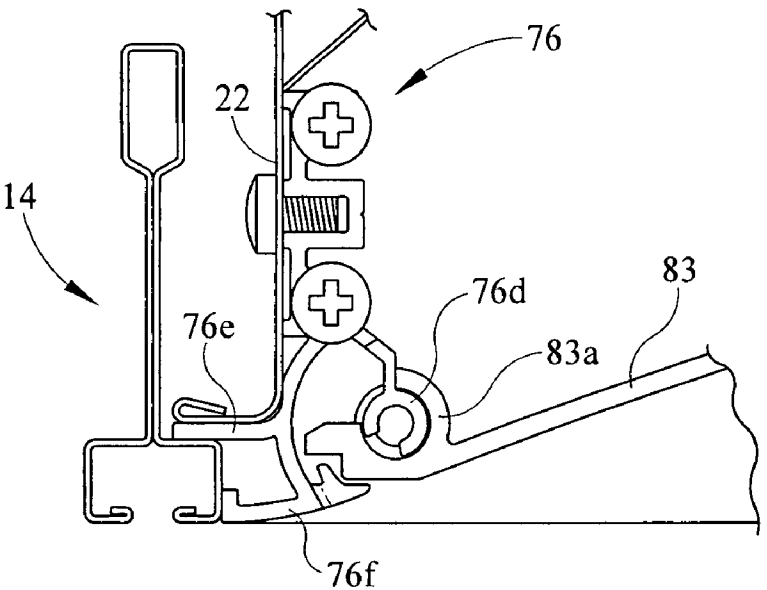

Referring now to FIG. 11, an extrusion 76 is shown in side view which provides for pivotal connection of each casting 80. The extrusion 76 has three fastener receptacles. Upper and lower starter fastener receptacles 76*a*, 76*b* are utilized on starter fixtures 20, which start or end a run of luminaires. Alternatively, the receptacles 76*a*, 76*b* may be utilized on fixtures 20 which are not used in a continuous run but are used singularly. The receptacles 76*a*, 76*b* receive a screw which is fastened to an end cap of the fixture 20. However, for joiner fixtures, used between the starter and end fixtures, the receptacles 76*a*, 76*b* are not used to fasten the fixture to a bulkhead 30. The extrusions 76 also comprise a housing fastener receptacle 76*c*. The receptacle 76*c* extends in a direction which is perpendicular to the axes of receptacles 76*a*, 76*b*. Beneath the extrusion receptacles 76*a*, 76*b*, 76*c* is a hinge pin 76*d* which has an axis extending in a direction parallel to the axes of the receptacle 76*a*, 76*b*. The hinge pin is received by the lens or faux reflector 83 to allow rotation of the lens from an upward position for use of the luminaire, to a downward position for installation and maintenance. The extrusion 76 also comprises first and second steps 76*e*, 76*f*, which are engaged depending on the type of ceiling structural member with which the fixture 20 is utilized. As shown in FIG. 12A, the fixture housing 22 is positioned adjacent to a slotted T-grid member 14. The foot 76*e* is seated along an upper surface of the slotted portion of the T-grid member 14 and the lower foot 76*f* is abutting the slotted T-grid member 14. Alternatively, in FIG. 12B, a normal inverted T-grid member is utilized, wherein the lower foot 76*f* is seated on the upper surface of the lower T-grid member. Also depicted in FIG. 12, the lens 83 includes a socket 83*a* which engages a pin number 76*d* in either embodiment, the lower foot 76*f* also acts as a stop for pivotal motion of the lens 83.

Figure 13:
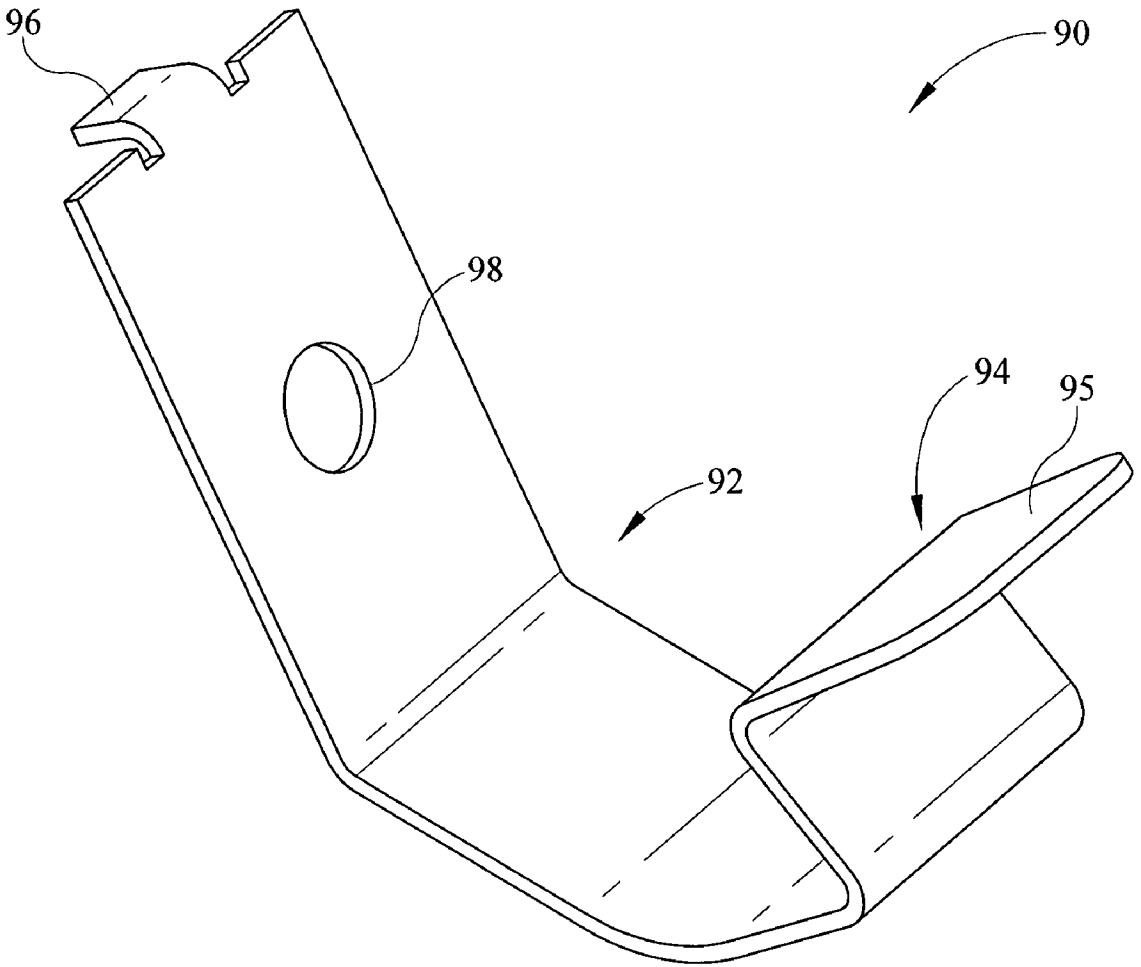
FIG. 13 depicts a perspective view of a spring clip.
Figure 14:
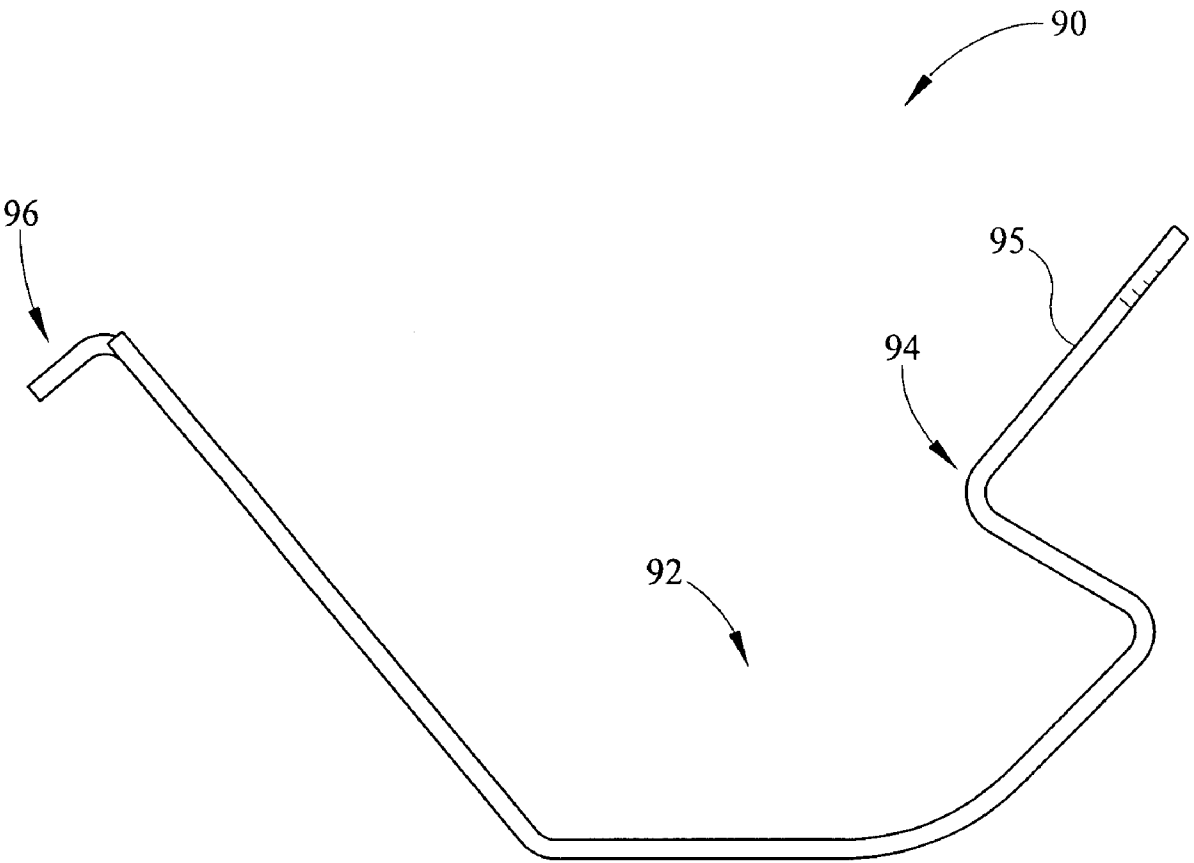
FIG. 14 depicts a side view of the spring clip of FIG. 13.

Referring now to FIGS. 13 and 14, a spring clip 90 is depicted in perspective and side views, respectively. The spring clip 90 includes a body 92 having a shoulder 94 adjacent one side of the body, and a foot 96 adjacent an opposite side of the body 92. Disposed along the body is a fastener 98. The spring clip 90 is fastened by the fastening aperture 98 to the lamp shield 100. The foot 96 extends through an opening in the lamp shield 100 in order to inhibit pivoting about an axis extending through the fastener aperture 98. As shown in FIGS. 8 and 9, the lamp shield 100 is lifted so that the shoulder 94 engages a pin 89 extending from the casting structure 84*b* the spring clip 90 is formed of a resilient material which allows some deformation, so that the shoulder 94 can pass the pin 89, and then latch about the upper portion of the pin 89 to retain the lamp shield 100 in position. In order to remove the diffuser, the upper neck portion 95 of the spring clip 90 above the shoulder 94 is merely grasped to slightly deform the spring clip 90, so that the clip 90 disengages the pin 89 and the diffuser 100 may be removed.

Referring now to FIGS. 15A-15D, installation of the fixture 20 is depicted. As previously described, the lamp shield or diffuser 100 allows for tool-less installation and removal from the castings 80. As a result, various maintenance matters for the luminaire may be performed without tools. According to FIG. 15A, the diffuser 100 is shown spaced from the fixture 20 and the faux reflectors 83 along with the castings 80 are shown in the downward position, pivoted downwardly from the extrusions 76 and revealing the interior rear reflectors 70, 72 are shown. A lamp is not shown extending between the lamp socket 76 simply for clarity.

Figure 15A:
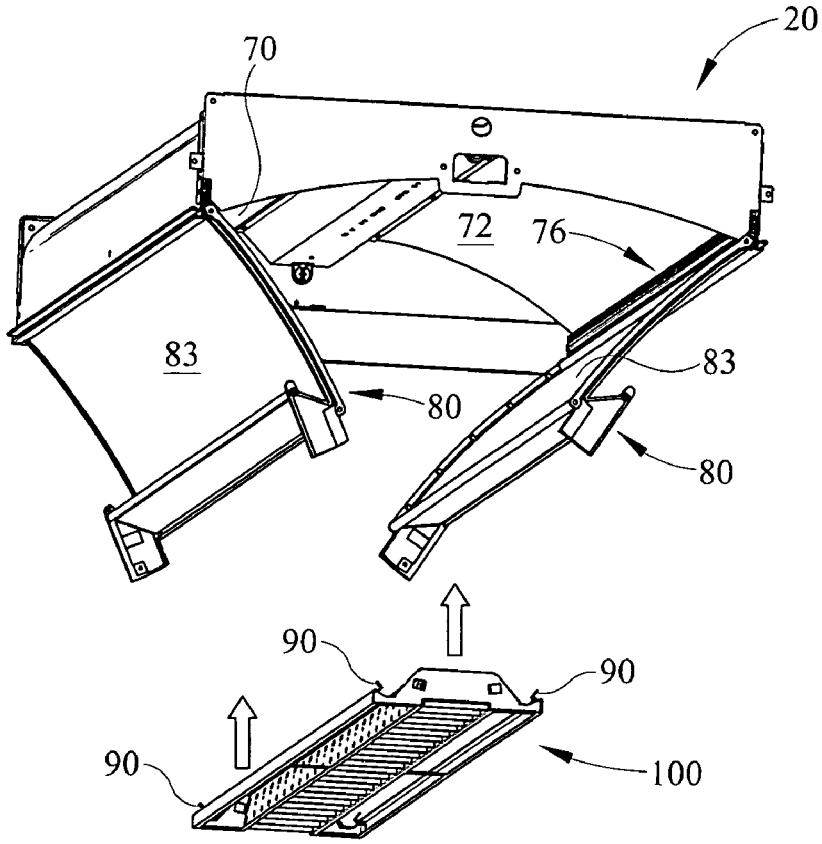
FIGS. 15A-15D depict perspective views of the assembly of the troffer luminaire.
Figure 15B:
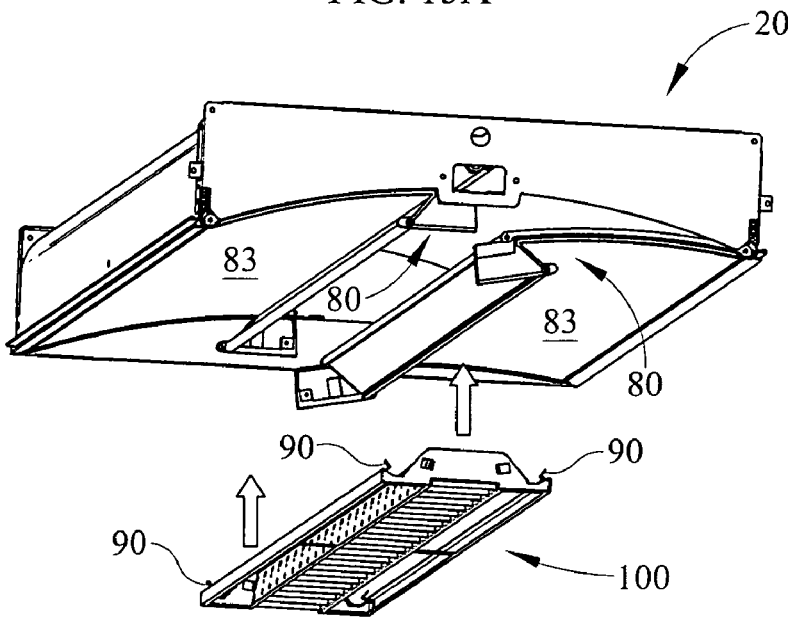

Referring now to FIG. 15B, the castings 80 and faux reflectors 83 are rotated upwardly about the extrusions 76 to an almost fully closed position. The diffuser 100 is moved upwardly closer to the castings 80.

Figure 15C:
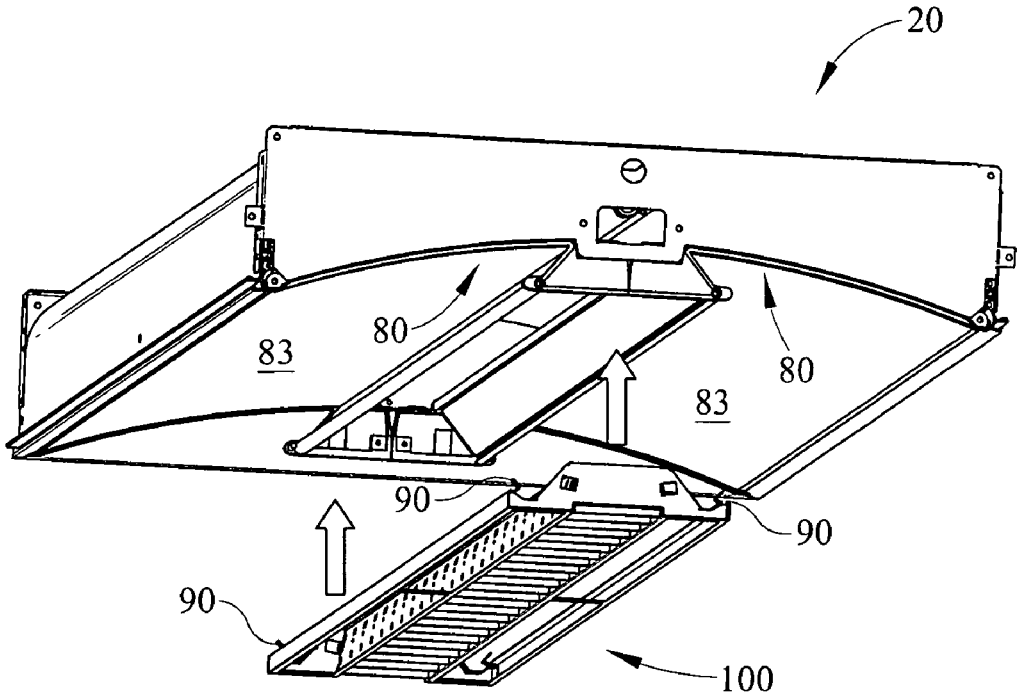

Referring now to FIG. 15C, the assembly defined by castings 80 and lens 83 are shown in the fully upward, operating position. The inside surfaces of the central portion of lens 83 is in direct communication with the lamp (now shown) above. The central portion is substantially frusto-triangular in shape and is defined by the opposite sides of castings 80 and lower lens portions.

Figure 15D:
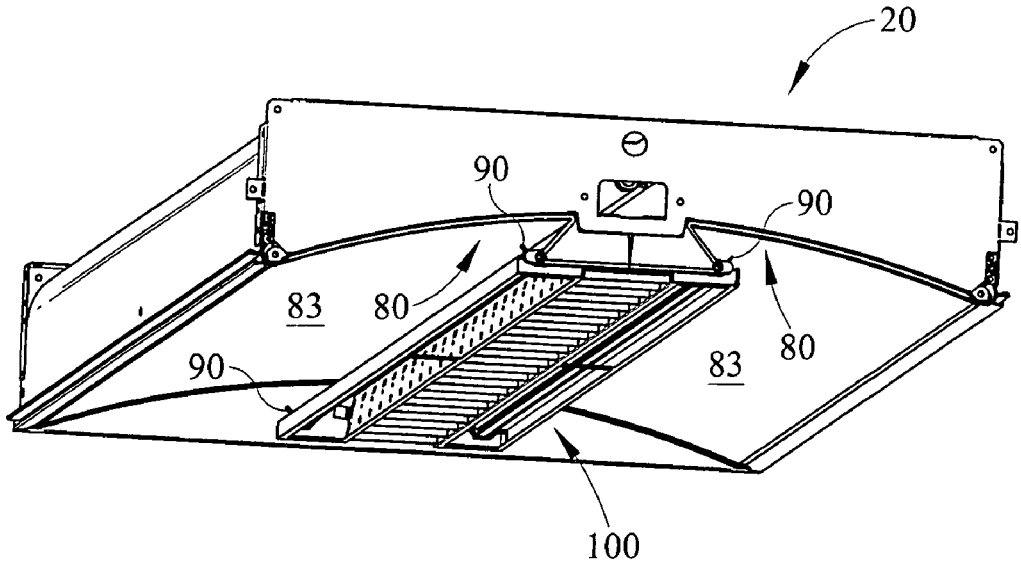

As shown in FIG. 15D, the diffuser 100 is moved upwardly so that spring clips 90 move over pins 89 and the diffuser 100 is retained in this position. This makes removal and replacement easy, as well as allowing use of alternate diffusers which utilize such spring clip 90 design and placement.

Figure 16:
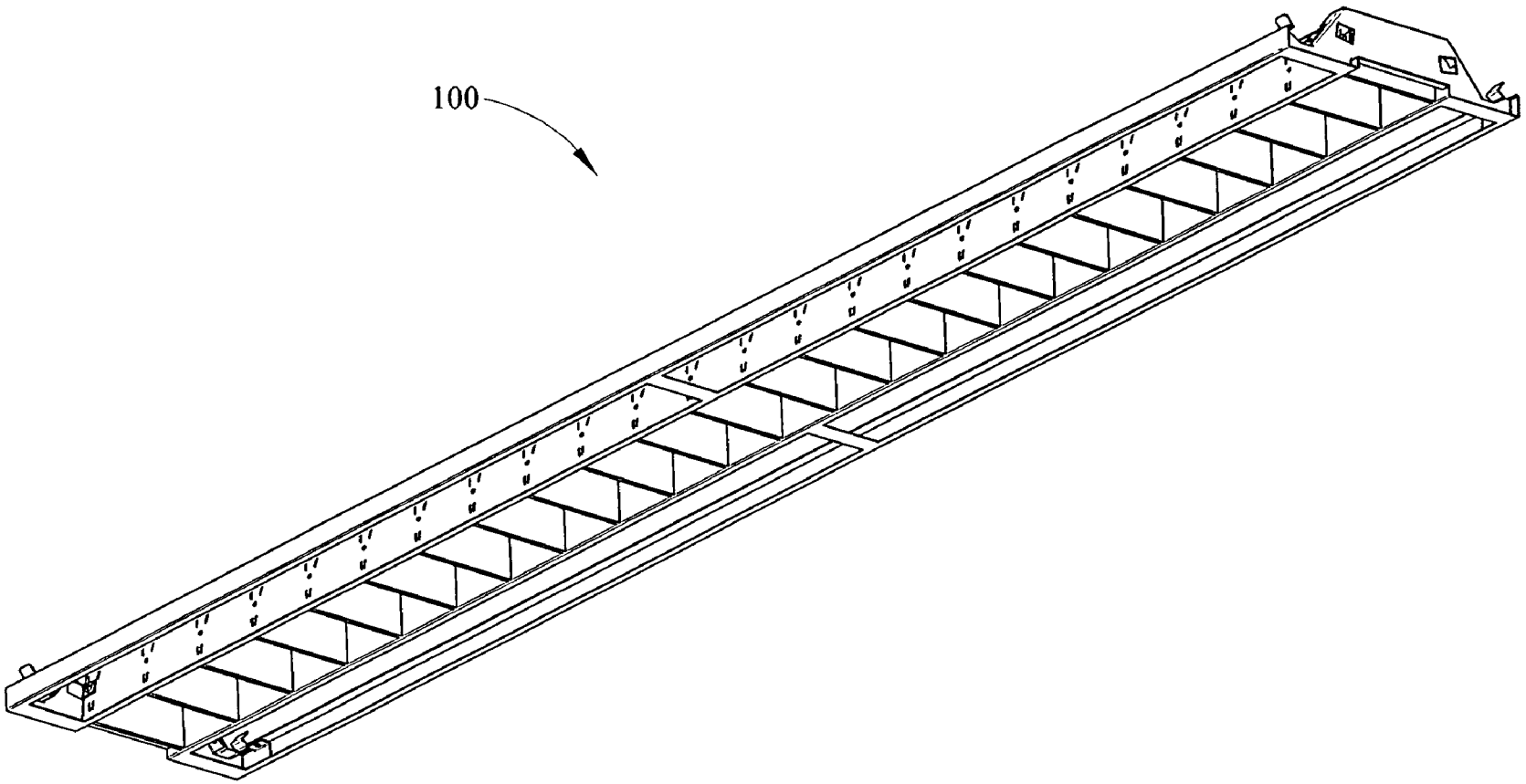
FIGS. 16-21 show perspective views of various luminaire lamp shields.
Figure 17:
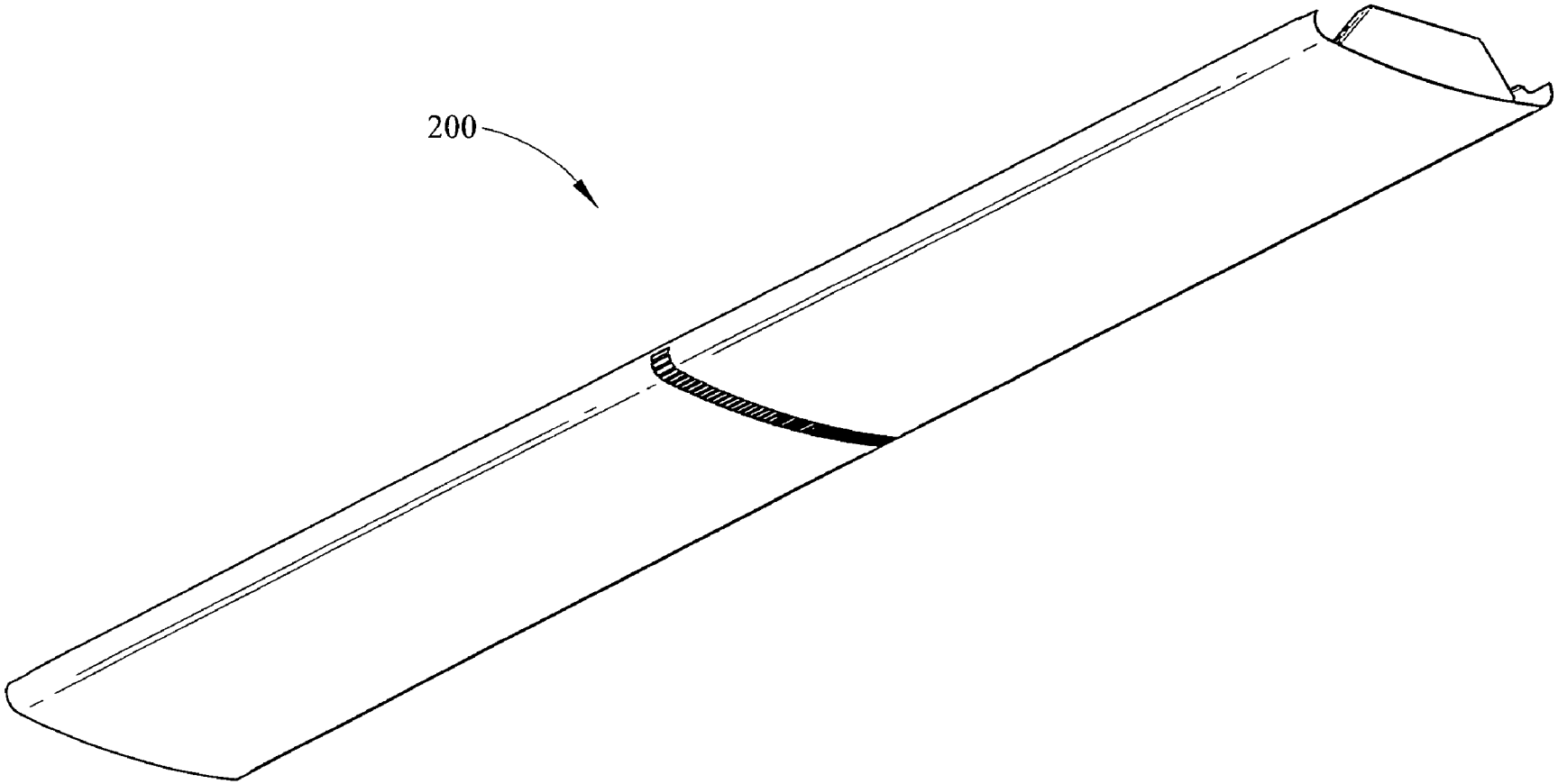
Figure 18:
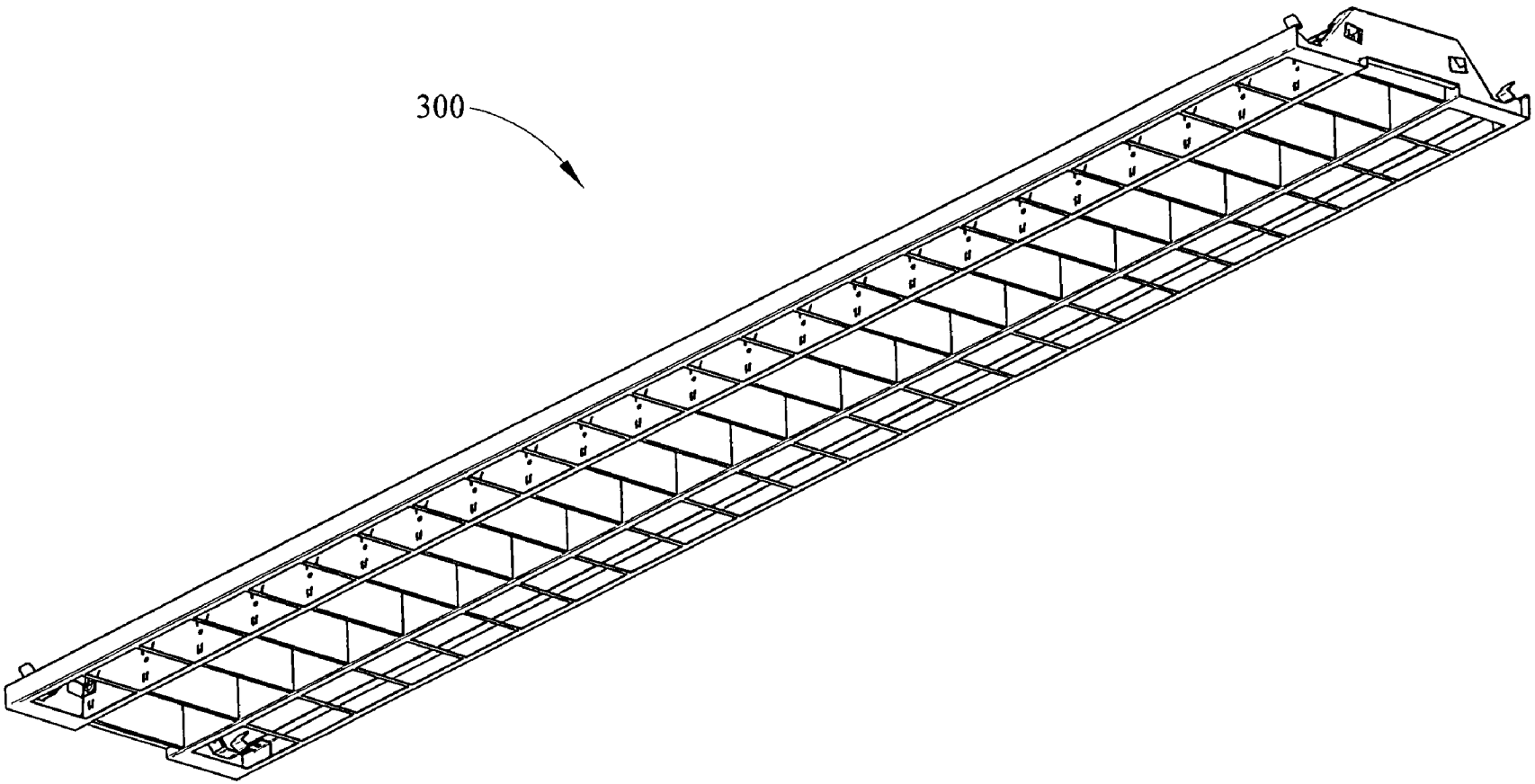
Figure 19:
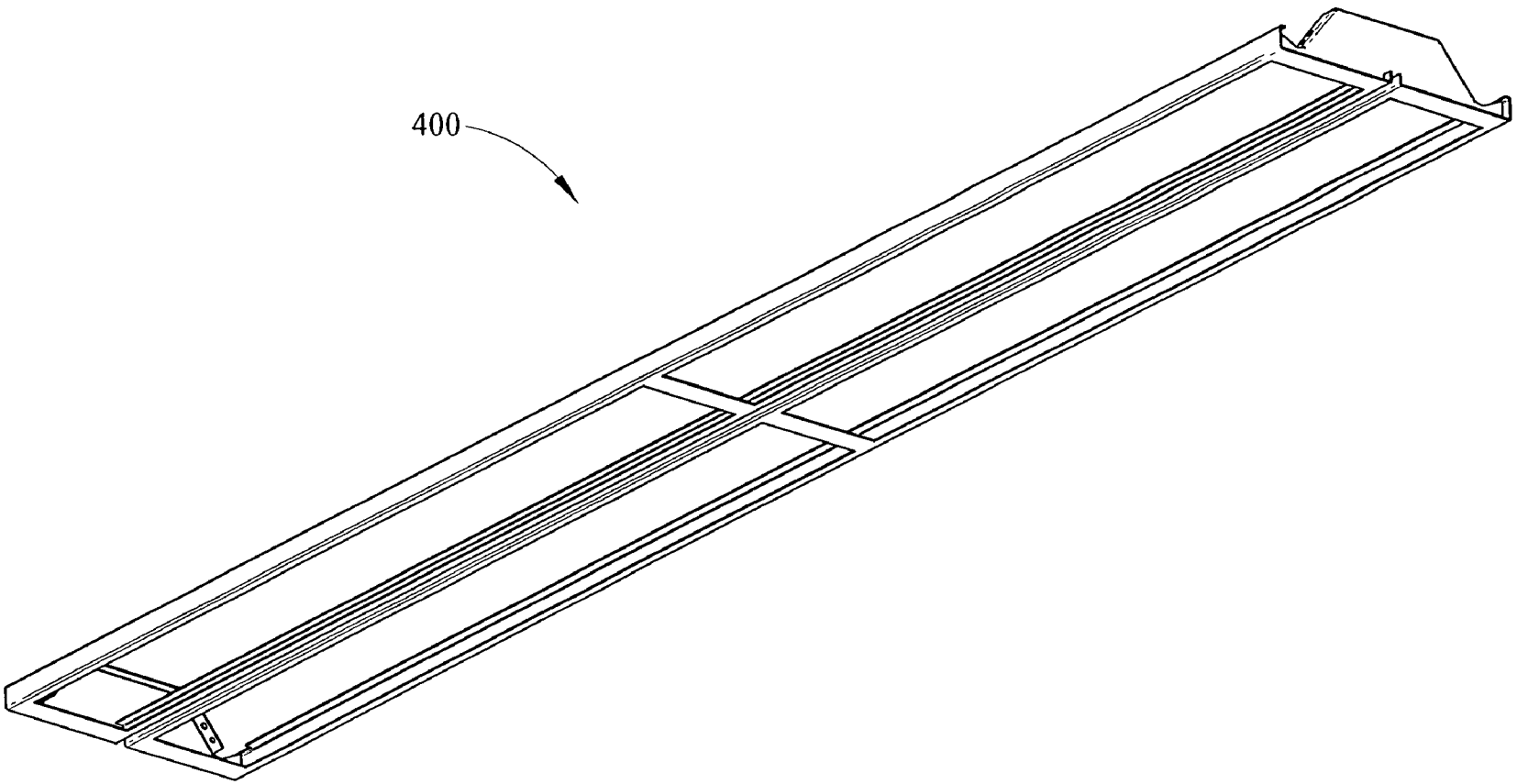
Figure 20:
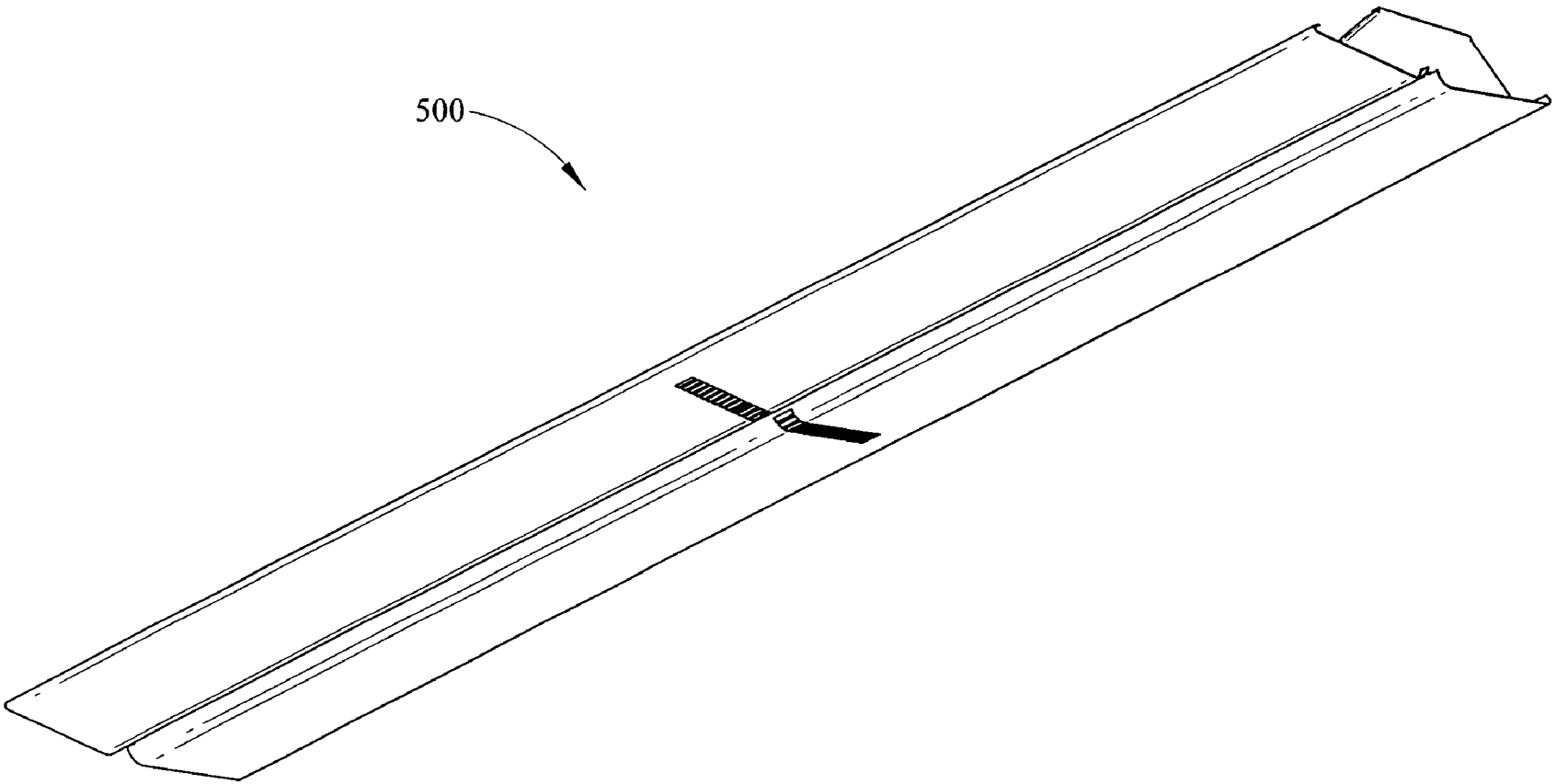
Figure 21:
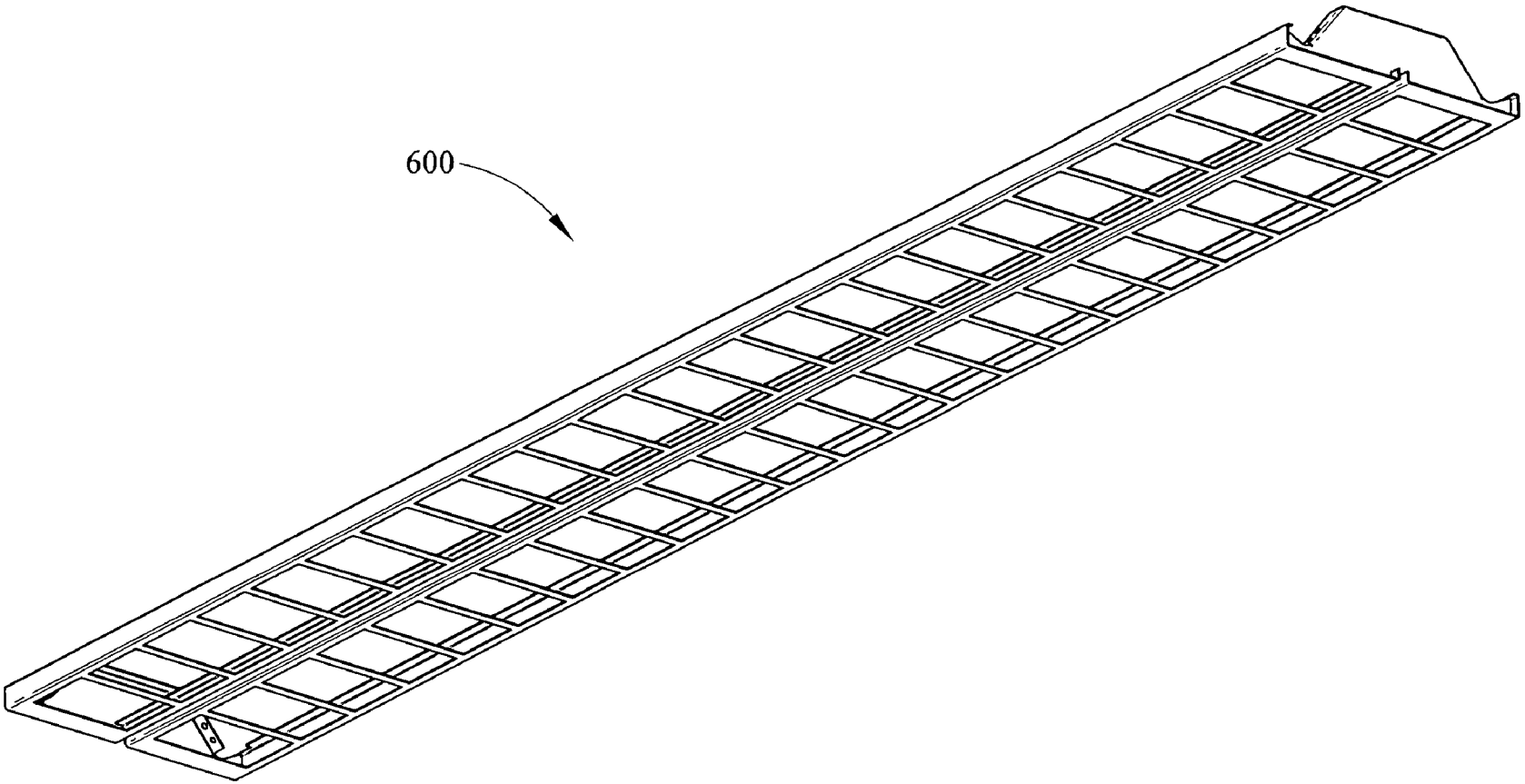

Referring now to FIGS. 16-21, various alternative lamp shields 100 are depicted in perspective view. The lamp shields depicted are generally four (4) feet long however the troffer housings 22 may be four (4) feet or two (2) feet in length and therefore the lamp shields 100 and alternatives may be either four (4) feet or two (2) feet in length. As shown in FIG. 16, a lamp shield 100 is depicted with the lenses along sides of the shield 100 removed. The lamp shield 100 is a louver type with elongated lenses along sides of the shield 100. The lamp shield 100 is positioned over an opening at the between the faux reflectors 83. Since the lamp shield 100 is positioned over an opening, the lamp shield 100 allows for tool-less entry for lamp changes and re-lamping. The spring clips 90, previously described allows for tool-less removal and engagement of the lamp shield 100 to gain access to areas within the housing 22 for maintenance. The lamp shields 200, 300, 400, 500 are all interchangeable with the lamp shield 100 and the luminaire housing 20. As shown in FIG. 17, the lamp shield 200 generally includes an arcuate metal shield having a plurality of piercings. The lamp shield 200 generally includes a radially curved metallic shield portion. The piercings are shown only at the central portion of the metal shield for clarity, however, the piercings extend along the entire surface of shield. Referring to FIG. 18, the side openings also comprise lenses (not shown) however, cross members are shown within the side openings, as opposed to the openings of FIG. 16 where the cross members are not shown. As a resulted the lens portions along the sides of the lamp shield 300 are segmented. Referring now to FIG. 19, a lens panel design is provided with the lamp shield 400. According to the four foot version depicted, two lens panels are located extending on each longitudinal edge of the lamp shield 400. In a two foot version, the panel would only have one lens extending along each side of the lamp shield 400. In FIG. 20, the lamp shield is formed of two curvilinear pierced members. This lamp shield 500 is substantially wing shaped formed of metal and having piercings along the entire surface. The piercings are only depicted near the center of the fixture for clarity. Referring now to FIG. 21, a further alternative lamp shield 600 is depicted having a panel design with a plurality of cross members to provide a segmented lens appearance. The cross-members define a plurality of square apertures wherein at least one lens is positioned.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A troffer luminaire, comprising:

a troffer housing;

a rear reflector a first faux reflector assembly pivotally mounted in said troffer housing;

a second faux reflector assembly pivotally mounted in said troffer housing opposite said first reflector assembly; and, each of said first and second faux reflector assemblies including a downwardly depending leg;

an interchangeable diffuser connected to said first faux reflector assembly and said second faux reflector assembly near lower ends of said downwardly depending legs.

2. The troffer luminaire of claim 1, said diffuser having a plurality of perforations.

3. The troffer luminaire of claim 1, said diffuser having at least one lens.

4. The troffer luminaire of claim 1, said interchangeable diffuser being toollessly removable.

5. The troffer luminaire of claim 1, said diffuser receiving light from said lamp through and opening between said first reflector assembly and said second reflector assembly.

6. The troffer luminaire of claim 1, said interchangeable diffuser mounted beneath an opening defined between said first faux reflector assembly and said second faux reflector assembly.

7. A troffer luminaire, comprising;

a troffer housing;

a rear reflector disposed within said troffer housing;

at least one faux reflector assembly including a downwardly depending leg and being pivotally mounted within said troffer housing; and a removable diffuser mounted near a lower end of said downwardly depending leg on a centrally disposed casting of said at least one faux reflector assembly, said removable diffuser being mountable and dismountable in a tool-less manner.

8. The troffer luminaire of claim 7 further comprising a plurality of spring clips mounted to one of said at least one faux reflector assembly and said removable diffuser.

9. The troffer luminaire of claim 8 further comprising a plurality of pins extending from the other of said removable diffuser and said at least one faux reflector.

10. The troffer luminaire of claim 9, said plurality of spring clips releasably engaging said plurality of pins.

11. A luminaire, comprising:

a fixture housing;

a rear reflector;

a first reflector extending between a first pivotable casting and a second pivotable casting;

a second reflector extending between a third pivotable casting and a fourth pivotable casting;

said first reflector having a lower portion and said second reflector having an adjacent lower portion, said lower portions having a preselected geometric shape and defining a lower aperture;

a diffusing lamp shield removably connected to said castings and covering said lower aperture.

12. The luminaire of claim 11, said castings having one of pins or spring clips.

13. The luminaire of claim 12, said lamp shield having the other of pins or springs clips.

14. The luminaire of claim 13, said pins engaging said spring clips.

15. The luminaire of claim 14, said lamp shield being interchangeable with alternate shields.

* * * * *